US011201381B1

(12) United States Patent
Mruk et al.

(10) Patent No.: US 11,201,381 B1
(45) Date of Patent: Dec. 14, 2021

(54) CORPORATE POWER SPLITTER WITH INTEGRATED FILTERING

(71) Applicant: FIRST RF Corporation, Boulder, CO (US)

(72) Inventors: Joseph René Mruk, Boulder, CO (US); Robert Patterson Scheeler, Boulder, CO (US)

(73) Assignee: FIRST RF Corporation, Boulder, CO (US)

( * ) Notice: Subject to any disclaimer, the term of this patent is extended or adjusted under 35 U.S.C. 154(b) by 148 days.

(21) Appl. No.: 16/751,906

(22) Filed: Jan. 24, 2020

Related U.S. Application Data

(60) Provisional application No. 62/958,162, filed on Jan. 7, 2020.

(51) Int. Cl.

| | |
|---|---|
| ***H01P 5/19*** | (2006.01) |
| ***H01Q 21/00*** | (2006.01) |
| ***H01P 3/08*** | (2006.01) |
| ***H01P 1/203*** | (2006.01) |

(52) U.S. Cl.
CPC ..... *H01P 5/19* (2013.01); *H01P 1/20336* (2013.01); *H01P 3/081* (2013.01); *H01Q 21/0006* (2013.01)

(58) Field of Classification Search
CPC ..... H01P 5/19; H01P 1/20336; H01P 3/081; H01Q 21/006
USPC ..... 333/134
See application file for complete search history.

(56) References Cited

U.S. PATENT DOCUMENTS

| | | | | |
|---|---|---|---|---|
| 5,489,880 | A | 2/1996 | Swarup | |
| 5,847,625 | A * | 12/1998 | Gillette | H01P 5/16 333/127 |
| 2012/0274414 | A1 * | 11/2012 | Hung | H01P 5/16 333/125 |

OTHER PUBLICATIONS

Boone et al. (Oct. 2012) "Design of Microstrip Power Dividers with Filtering Functions," Conference Paper, 5 pages.
Chen et al. (Oct. 2015) "A Four-Way Microstrip Filtering Power Divider With Frequency-Dependent Couplings," IEEE Transactions on Microwave Theory and Techniques, vol. 63, No. 10, 11 pp.
Coburn "Broadband dual-use array with planar log periodic dipole elements," Applied Computational Electromagnetics Society Journal, vol. 32, No. 9, Sep. 2017, pp. 742-847.

* cited by examiner

*Primary Examiner* — Robert J Pascal
*Assistant Examiner* — Kimberly E Glenn
(74) *Attorney, Agent, or Firm* — Lathrop GPM LLP

(57) ABSTRACT

A filtering power divider includes a first partial transmission line having a first electrical length, a second partial transmission line having a second electrical length, and a third partial transmission line having the second electrical length. The first, second, and third partial transmission lines connect to form a T-junction, and a sum of the first and second electrical lengths is ninety degrees. Thus, the first and second partial transmission lines cooperate to act as a quarter-wave transmission line. Similarly, the first and third partial transmission lines cooperate to act as a quarter-wave transmission line. Additional transmission lines may be connected to the first, second, and third partial transmission lines to implement a filter between an input port and each of two output ports.

25 Claims, 18 Drawing Sheets

CORPORATE POWER SPLITTER WITH INTEGRATED FILTERING

RELATED APPLICATIONS

This application claims priority to U.S. Provisional Patent Application No. 62/958,162, filed Jan. 7, 2020, and titled "Corporate Power Splitter with Integrated Filtering", which is incorporated herein by reference in its entirety.

BACKGROUND

A corporate power splitter may be used to divide a single higher-power radio-frequency (RF) or microwave signal into a plurality of N lower-power signals that feed a corresponding plurality of N antenna elements of a passive, or fixed-beam, antenna array. Neighboring elements of the antenna array are typically separated by a fixed distance that is determined by the application at hand.

SUMMARY OF THE EMBODIMENTS

The present embodiments include power dividers and corporate power splitters that may be physically implemented near an antenna array, such as within the space between neighboring elements of the antenna array, advantageously utilizing much of the space that would be otherwise be wasted. As a result, the present embodiments help to reduce the overall volume of a passive antenna array system.

To further reduce volume and take advantage of the space between neighboring elements, the present embodiments also implement filters (e.g., bandpass filters) with distributed-element components located within the power divider or corporate power splitter. To counteract the doubling of impedance that typically arises in a 1:2 power divider, some of the present embodiments include impedance transformers that reduce the output impedances of the two output ports of the power divider. Advantageously, these impedance transformers also form part of the filters, and thus may be implemented within the space of the power splitter without any additional physically components. In some embodiments, a single impedance transformer is integrated with a two-port filter to create a two-port filter with different input and output impedances.

Some of the present embodiments utilize quarter-wave transmission lines that may be readily fabricated as microstrip transmission lines (or another type of planar or non-planar transmission line). Each of these quarter-wave transmission lines acts as a resonator, and the resonant transmission of electrical signals through these transmission lines helps to advantageously reduce loss when compared to non-resonant transmission lines that are sometimes used to construct corporate power dividers and couple electrical signals to antenna elements.

In embodiments, a filtering power divider includes a first partial transmission line having a first electrical length, a second partial transmission line having a second electrical length, and a third partial transmission line having the second electrical length. A first end of each of the first, second, and third partial transmission lines connect to form a T-junction, and a sum of the first and second electrical lengths is ninety degrees (i.e., one quarter of a wavelength of a signal at a center frequency $f_c$). Thus, the first and second partial transmission lines cooperate to act as a quarter-wave transmission line at the center frequency $f_c$. Similarly, the first and third partial transmission lines cooperate to act as a quarter-wave transmission line at the center frequency $f_c$. In some embodiments, a characteristic impedance of each of the second and third partial transmission lines equals twice a characteristic impedance of the first partial transmission line such that the T-junction splits a signal, propagating along the first partial transmission line and toward the T-junction, equally between the second and third partial transmission lines. In other embodiments, the characteristic impedances of the second and third partial transmission lines are unequal such that the T-junction splits the signal unequally between the second and third partial transmission lines. A parallel impedance of the second and third partial transmission lines equals the characteristic impedance of the first partial transmission line to minimize reflection of the signal at the T-junction.

In some embodiments, the filtering power divider further includes (i) a first set of one or more transmission lines connecting a second end of the first partial transmission line to an input port of the filtering power divider, (ii) a second set of one or more transmission lines connecting a second end of the second partial transmission line to a first output port of the filtering power divider, and (iii) a third set of one or more transmission lines connecting a second end of the third partial transmission line to a second output port of the filtering power divider. In these embodiments, the first and second sets of transmission lines cooperate with the first and second partial transmission lines to implement a filter between the input port and the first output port. In addition, the first and third sets of transmission lines cooperate with the first and third partial transmission lines to implement the filter between the input port and the second output port. Each of the transmission lines of the first, second, and third sets may be a quarter-wave transmission line. The filter may be, for example, a bandpass filter with a plurality of filter stages, wherein at least one of the filter stages is implemented with the first set of transmission lines, and at least one of the filter stages is implemented with each of the second and third sets of transmission lines.

In other embodiments, the filtering power divider further includes a first impedance transformer coupling the second end of the second partial transmission line to the second set of transmission lines. The first impedance transformer is configured to (i) cooperate with the second set of transmission lines to transform a characteristic impedance of the second partial transmission line to a first output impedance of the first output port, and (ii) cooperate with the first and second partial transmission lines, and the first and second sets of transmission lines, to implement the filter between the input port and the first output port. In addition, the filtering power divider further includes a second impedance transformer coupling the second end of the third partial transmission line to the third set of transmission lines. The second impedance transformer is configured to (i) cooperate with the third set of transmission lines to transform a characteristic impedance of the third partial transmission line to a second output impedance of the second output port, and (ii) cooperate with the first and third partial transmission lines, and the first and third sets of transmission lines, to implement the filter between the input port and the second output port.

In embodiments, a power-dividing method includes coupling a first signal into a T-junction through a first partial transmission line having a first electrical length, and splitting, with the T-junction, the first signal into second and third signals. The power-dividing method also includes coupling the second signal out of the T-junction through a second partial transmission line having a second electrical length, and coupling the third signal out of the T-junction through a third partial transmission line having the second electrical length. A sum of the first and second electrical lengths may be ninety degrees (at a center frequency $f_c$).

In embodiments, a power-combining method includes coupling a first signal out of a T-junction through a first partial transmission line having a first electrical length, coupling a second signal into the T-junction through a second partial transmission line having a second electrical length, coupling a third signal into the T-junction through a third partial transmission line having the second electrical length, and combining, with the T-junction, the second and third signals into the first signal. A sum of the first and second electrical lengths may be ninety degrees (at a center frequency $f_c$).

DETAILED DESCRIPTION OF THE EMBODIMENTS

Figure 1:
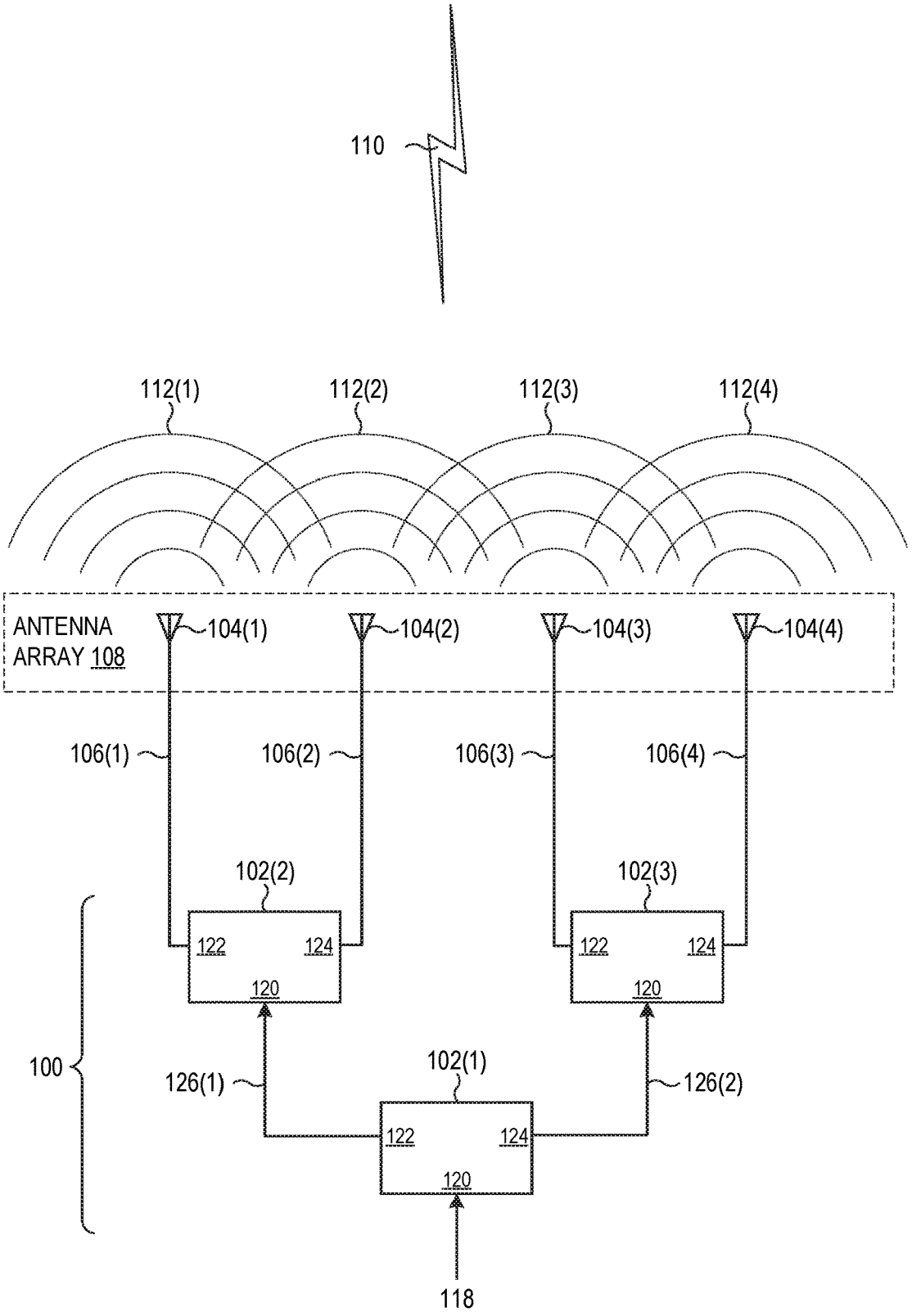
FIG. 1 is a schematic diagram of a corporate power splitter that splits one input signal into a plurality of N output signals that drive a corresponding plurality of N antenna elements of an antenna array, in embodiments.

FIG. 1 is a schematic diagram of a corporate power splitter 100 that splits one input signal 118 into a plurality of N output signals 106 that drive a corresponding plurality of N antenna elements 104 of an antenna array 108. The corporate power splitter 100 includes a plurality of power dividers 102, each having an input port 120, a first output port 122, and a second output port 124. In the example of FIG. 1, where N=4, a first power divider 102(1) splits the one input signal 118 into first and second intermediate signals 126(1) and 126(2), respectively. A second power divider 102(2) splits the first intermediate signal 126(1) into first and second output signals 106(1) and 106(2), respectively. Similarly, a third power divider 102(3) splits the second intermediate signal 126(2) into third and fourth output signals 106(3) and 106(4), respectively.

As shown in FIG. 1, the corporate power splitter 100 can form a binary tree with N−1 power dividers 102 arranged in $\log_2$ N cascaded layers, wherein each of the power dividers 102 forms a node of the binary tree. In FIG. 1, the first power divider 102(1) forms a first layer of a two-layer binary tree, and the second and third power dividers 102(2) and 102(3) form a second layer of the two-layer binary tree. More generally, for k=1, 2, . . . , $\log_2$ N, the $k^{th}$ layer contains $2^{k-1}$ power dividers 102. When each power divider 102 is lossless and divides the power at its input port 120 equally between each of its output ports 122 and 124, each output signal 106 has a power equal to $P_o/N=P_0/4$, where $P_o$ is the power of the input signal 118. While N=4 in the example of FIG. 1, the antenna array 108 may have a different number of antenna elements 104 (e.g., N=16, 256, 1024, or more) without departing from the scope hereof, wherein the corporate power splitter 100 is configured with the same number N of corresponding output signals 106. Any of the power dividers 102 may alternatively divide the power at its input port 120 unequally between its output ports 122 and 124, wherein the output signals 106 have different powers.

The antenna array 108 may be used, for example, as a passive electronically scanned array in which the antenna elements 104 are used with one transmitter and/or one receiver. The antenna elements 104, when driven with the output signals 106, emit corresponding electromagnetic fields 112 that interfere to form an electromagnetic beam 110 whose properties (e.g., frequency, spatial beamwidth, angular direction, side-lobe properties, etc.) depend, in part, on the amplitudes and relative phases of the output signals 106. Although not shown in FIG. 1, the output signals 106 may be time-delayed to induce relative phase shifts therebetween. For example, the output signals 106 may propagate to their corresponding antenna elements 104 along transmission lines of varying lengths. Alternatively, an electronically controllable phase shifter (not shown) may be added before each antenna element 104, wherein the angular direction of the electromagnetic beam 110 is electronically steerable.

Each of the power dividers 102 is a passive device that acts as a reciprocal network (i.e., the S-parameters between any two ports are the same regardless of the direction of propagation between the two ports) and thus can operate in reverse as a power combiner. Therefore, while FIG. 1 shows the antenna array 108 operating to transmit the electromagnetic beam 110, the antenna array 108 may alternatively operate to receive the electromagnetic beam 110. In this case, the corporate power splitter 100 combines the signals 106, as outputted by the antenna elements 104, to produce the one signal 118 as an output of the first power divider 102(1). This one output signal 118 may be subsequently processed by a receiver (not shown). Accordingly, in the following description, the terms "power divider" and "power splitter" refer to a device that performs both splitting and combining. The terms "divider" and "splitter" are synonymous, in accordance with their usage in the art.

Figure 2:
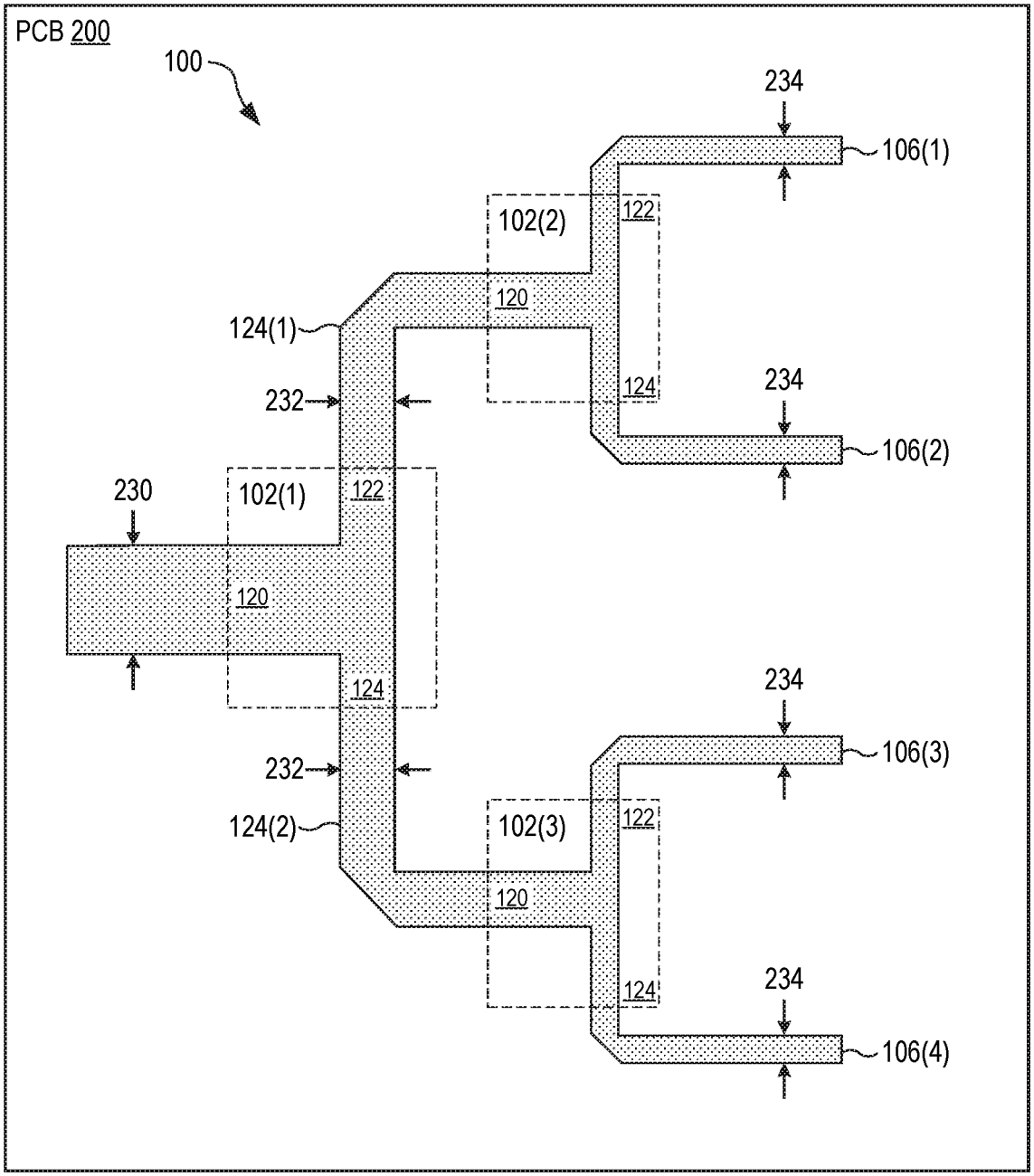
FIG. 2 shows the corporate power splitter of FIG. 1 implemented with planar transmission lines (e.g., microstrip) fabricated on a printed circuit board (PCB).

FIG. 2 shows the corporate power splitter 100 of FIG. 1 implemented with planar transmission lines (e.g., microstrip) fabricated on a printed circuit board (PCB) 200. In FIG. 2, each power divider 102 is a T-junction with an input impedance at the input port 120, a first output impedance at the first output port 122, and a second output impedance at the second output port 124. When splitting power equally between the output ports 122 and 124, each of the first and second output impedances may equal twice the corresponding input impedance. A width of each transmission line decreases as its characteristic impedance increases, and therefore a width of each input port 120 is larger than that of each of the corresponding output ports 122 and 124. For example, in FIG. 2 a width 230 of the input port 120 of the first power divider 102(1) is larger than a width 232 of the output ports 122 and 124 of the first power divider 102(1). In addition, the width 232 of the input port 120 of the second power divider 102(2) is larger than a width 234 of the corresponding output ports 122 and 124, and similarly for the third power divider 102(3).

One drawback with the implementation shown in FIG. 2 is that as N grows, and more power dividers 102 are needed, the widths of the output ports 122, 124 will continue to decrease until they are too small to be reliably fabricated. In addition, the increasing impedance of the output ports 122, 124 may result in impedance mismatches with the corresponding antenna elements 104. These impedance mismatches generate reflections that disadvantageously reduce the amount of power emitted by the antenna array 108.

Some of the present embodiments advantageously circumvent these difficulties by incorporating an impedance transformer between each output port 122, 124 and the subsequent input port 120. These transformers reduce the impedance so that the widths of the transmission lines do not decrease as N grows. Thus, these embodiments enable the antenna array 108 to have a substantially greater number of antenna elements 104, in turn expanding its utility for many applications. In addition, these impedance transformers can be implemented with components already present within each power divider 102 for filtering the signals, and thus without additional physical components that consume volume and area.

Figure 3:
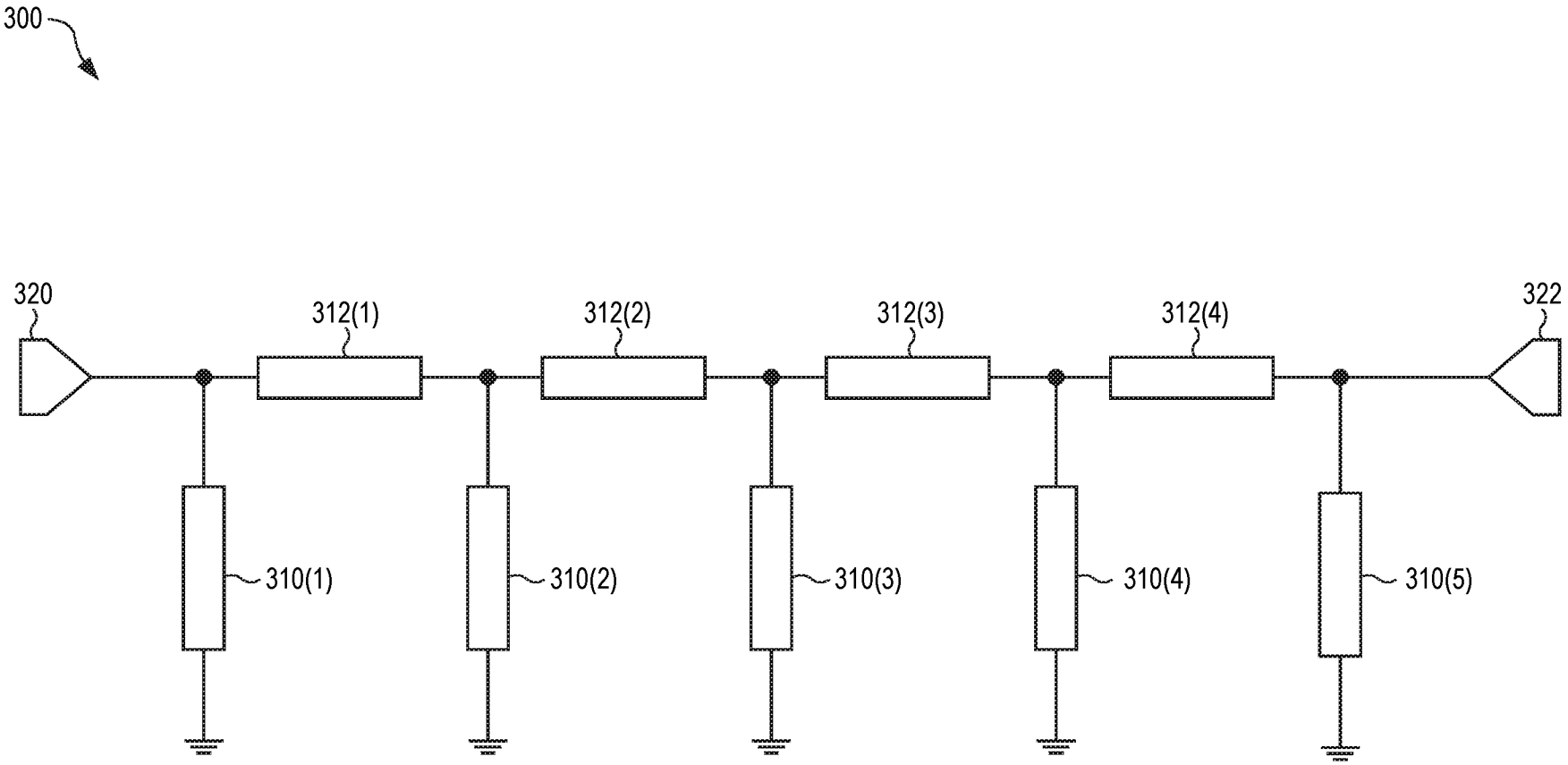
FIG. 3 is a schematic diagram of a two-port bandpass filter constructed from an alternating series of shunted resonators and series-connected resonators.

FIG. 3 is a schematic diagram of a two-port bandpass filter 300 constructed from an alternating series of shunted resonators 310 and series-connected resonators 312. In the following discussion, the two-port bandpass filter 300 is a distributed-element filter where each of the resonators 310, 312 is a quarter-wave transmission line 310, 312, i.e., each quarter-wave transmission line 310, 312 has a length corresponding to a 90° delay at a center frequency $f_c$. In this case, each shunted resonator 310 is a shunted quarter-wave transmission line 310 that is functionally equivalent to a quarter-wave stub. The two-port bandpass filter 300 has first and second ports 320, 322 with the same system impedance $Z_o$. The two-port bandpass filter 300 is a passive device, and therefore performs symmetrically with respect to the first and second ports 320, 322.

The two-port bandpass filter 300 is shown in FIG. 3 as a five-stage Chebyshev filter. However, the two-port bandpass filter 300 may have a different type of response (e.g., Butterworth, elliptic, etc.) without departing from the scope hereof. Similarly, the two-port bandpass filter 300 may be alternatively formed with a different number of stages than shown in FIG. 3 (e.g., 6, 7, 8, 9, or more) without departing from the scope hereof.

Figure 4:
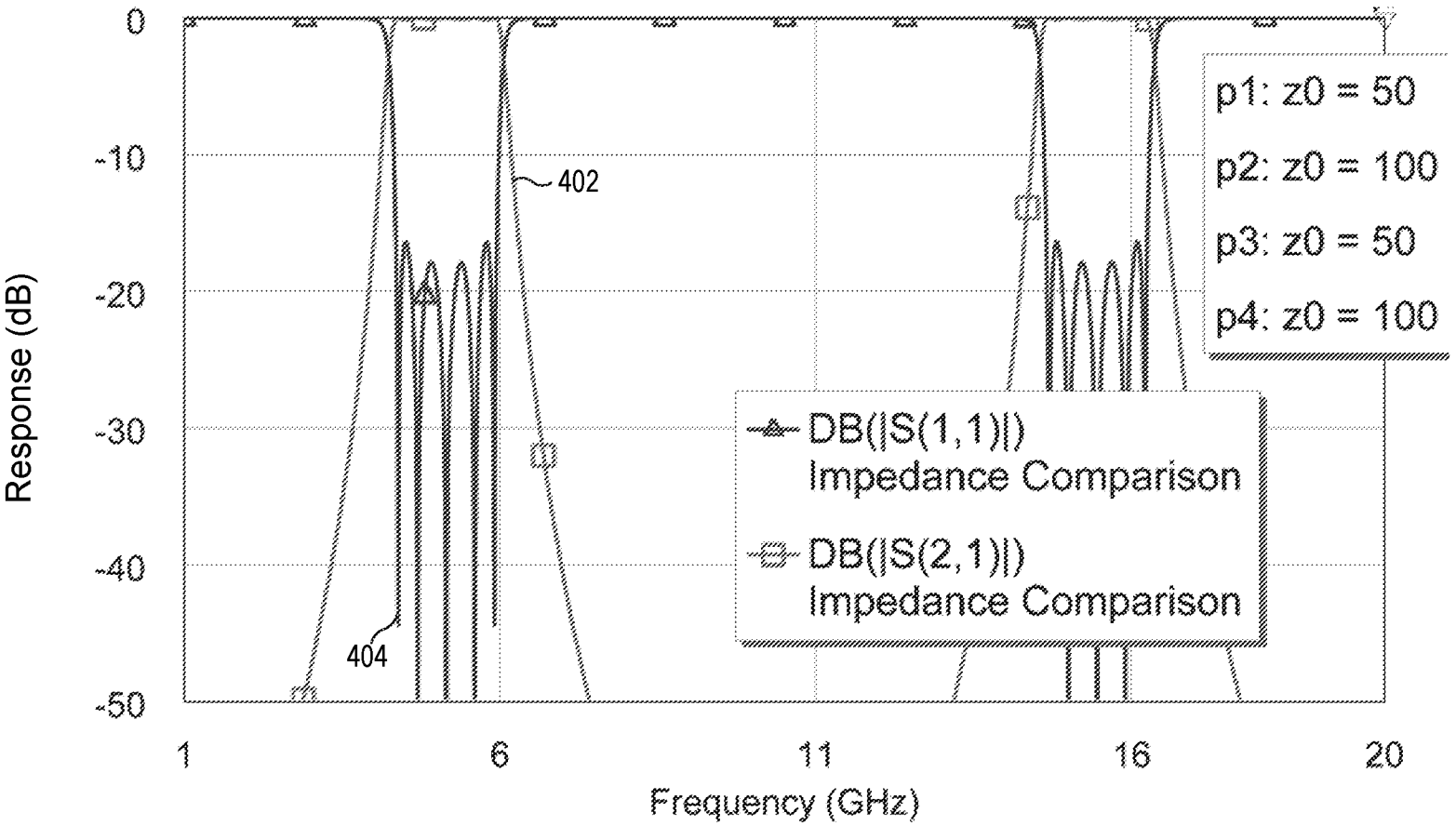
FIG. 4 is a plot showing transmission and reflection, as a function of frequency, of the two-port bandpass filter of FIG. 3.

FIG. 4 is a plot showing transmission 402 and reflection 404, as a function of frequency, of the two-port bandpass filter 300 of FIG. 3. The transmission 402 and reflection 404 were computed from a 2×2 S-matrix assuming the following filter characteristics: (1) a center frequency of $f_c$=5.15 GHz, (2) a maximum passband ripple of 0.1 dB, and (3) a fractional bandwidth of 25%. It was also assumed that each quarter-wave transmission line 310, 312 is ideal, the input and output impedances both equal a system impedance of $Z_o$=50Ω, and the input and output are impedance-matched to a source and load, respectively. The transmission 402 is the magnitude of the off-diagonal element of the S-matrix (i.e., $|S_{1,2}|$), and the reflection 404 is the magnitude of the first diagonal element of the S-matrix (i.e., $|S_{1,1}|$). Since the two-port bandpass filter 300 uses quarter-wave transmission lines 310 and 312, the transmission 402 and reflection 404 repeat at odd harmonics of the center frequency $f_c$ (e.g., $3f_c$=15.45 GHz, $5f_c$=25.75 GHz, etc.).

Impedances for the quarter-wave transmission lines 310, 312 were obtained from network synthesis equations using g-factors for the corresponding prototype low-pass filter. For a general prototype filter with N shunted transmission lines 310 and N−1 series-connected transmission lines 312, the network synthesis equations are:

$$\tilde{Y}_{12} = \sqrt{\frac{hg_0}{g_2}}\sin(\theta_c) \tag{1}$$

$$\tilde{Y}_1 = \Omega_c g_1 g_0 - \tilde{Y}_{12} = \Omega_c g_1 g_0 - \sqrt{\frac{hg_0}{g_2}}\sin(\theta_c)$$

$$\tilde{Y}_{k,k+1} = \frac{h}{\sqrt{g_k g_{k+1}}}\sin(\theta_c)$$

$$\tilde{Y}_k = h\Omega_c - \left(\tilde{Y}_{k-1,k} + \tilde{Y}_{k,k+1}\right)$$

$$\tilde{Y}_{N-1,N} = \sqrt{\frac{hg_{N+1}}{g_{N-1}}}\sin(\theta_c)$$

$$\tilde{Y}_N = \Omega_c g_N g_{N+1} - \tilde{Y}_{N-1,N} = \Omega_c g_N g_{N+1} - \sqrt{\frac{hg_{N+1}}{g_{N-1}}}\sin(\theta_c);$$

where $\tilde{Y}_i$ is the normalized admittance of the $i^{th}$ shunted transmission line 310(*i*), $\tilde{Y}_{i,i+1}$ is the normalized admittance of the $i^{th}$ series-connected transmission line 312(*i*), $\theta_c=(\pi/2)*(f_1/f_c)$, and $\Omega_c=\tan(\theta_c)$, where $f_1$ is the lower cutoff frequency of the passband. Eqns. 1 assume that the input and output impedances are both equal to the system impedance $Z_0$. To normalize the admittances, which is equivalent to setting $Z_0$ equal to 1, both $g_0$ and $g_{N+1}$ are set to 1. Also in Eqns. 1, k is restricted to integers between 2 and N−2, and his a design parameter set to 1. More details about Eqns. 1 may be found on pages 120-121 of *Microstrip Transmission*

*Line Filters* by J. A. G. Malherbe (Artech House, Dedham, M A, 1979). Table 1 below lists the characteristic impedances Z of the quarter-wave transmission lines 310, 312 for the five-stage (i.e., N=5) Chebyshev filter 300 with the filter characteristics listed above. For each quarter-wave transmission line 310, 312, the corresponding normalized admittance $\tilde{Y}$ from Eqns. 1 is inverted into a normalized impedance $\tilde{Z}$. The normalized impedance $\tilde{Z}$ is then multiplied by the system impedance $Z_0$=50Ω to obtain the characteristic impedance Z of said each quarter-wave transmission line 310, 312.

TABLE 1

Exemplary Impedances for the Transmission Lines 310, 312 of the Two-Port Bandpass Filter 300

| Transmission Line Identifier | Normalized Impedance | Transmission-Line Impedance |
|---|---|---|
| 310(1) | $\tilde{Z}_1 = 1/\tilde{Y}_1 = 0.2029$ | $Z_1 = \tilde{Z}_1 Z_0 = 10.145\Omega$ |
| 312(1) | $\tilde{Z}_{1,2} = 1/\tilde{Y}_{1,2} = 1.1940$ | $Z_{1,2} = \tilde{Z}_{1,2} Z_0 = 59.700\Omega$ |
| 310(2) | $\tilde{Z}_2 = 1/\tilde{Y}_2 = 0.2783$ | $Z_2 = \tilde{Z}_2 Z_0 = 13.915\Omega$ |
| 312(2) | $\tilde{Z}_{2,3} = 1/\tilde{Y}_{2,3} = 1.6778$ | $Z_{2,3} = \tilde{Z}_{2,3} Z_0 = 83.890\Omega$ |
| 310(3) | $\tilde{Z}_3 = 1/\tilde{Y}_3 = 0.2607$ | $Z_3 = \tilde{Z}_3 Z_0 = 13.035\Omega$ |
| 312(3) | $\tilde{Z}_{3,4} = 1/\tilde{Y}_{3,4} = 1.6778$ | $Z_{3,4} = \tilde{Z}_{3,4} Z_0 = 83.890\Omega$ |
| 310(4) | $\tilde{Z}_4 = 1/\tilde{Y}_4 = 0.2783$ | $Z_4 = \tilde{Z}_4 Z_0 = 13.915\Omega$ |
| 312(4) | $\tilde{Z}_{4,5} = 1/\tilde{Y}_{4,5} = 1.1940$ | $Z_{4,5} = \tilde{Z}_{4,5} Z_0 = 59.700\Omega$ |
| 310(5) | $\tilde{Z}_5 = 1/\tilde{Y}_5 = 0.2029$ | $Z_5 = \tilde{Z}_5 Z_0 = 10.145\Omega$ |

Filtering Power Divider

Figure 5:
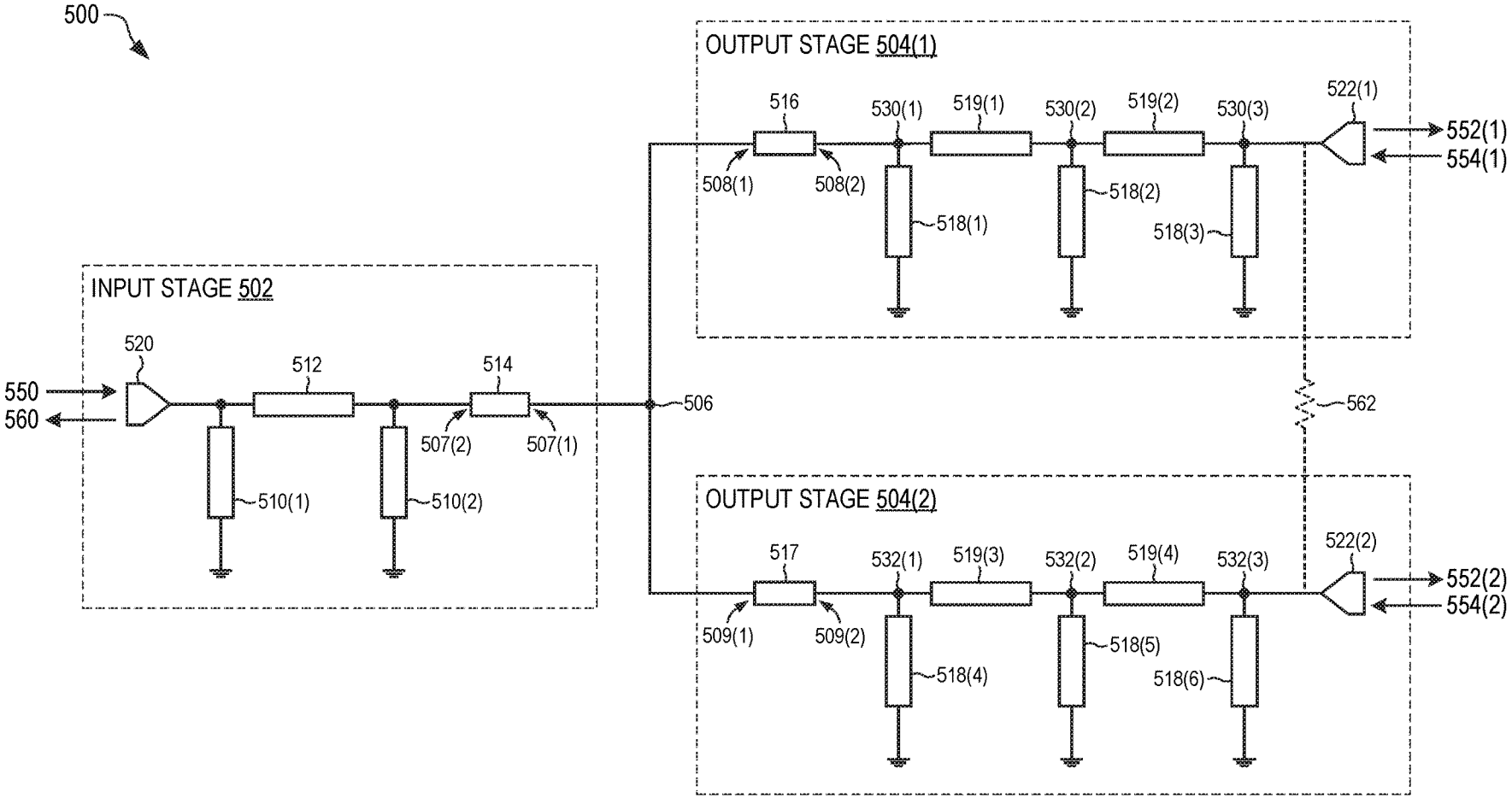
FIG. 5 is a schematic diagram of a filtering power divider that advantageously combines a 1:2 splitter/combiner with the bandpass filter of FIG. 3, in embodiments.

FIG. 5 is a schematic diagram of a filtering power divider 500 that advantageously combines a 1:2 splitter/combiner with the bandpass filter 300 of FIG. 3. The filtering power divider 500 may replace any or all of the power dividers 102 of FIG. 1 to advantageously add filtering to the corporate power divider 100. Accordingly, a filtering corporate power splitter may be formed by cascading a plurality of the filtering power divider 500.

The filtering power divider 500 has an input stage 502 that receives an input signal 550 at an input port 520, a first output stage 504(1) that outputs a first output signal 552(1) at a first output port 522(1), and a second output stage 504(2) that outputs a second output signal 552(2) at a second output port 522(2). When the first output port 522(1) is connected to another device, a first reverse signal 554(1) may be coupled into the first output port 522(1). Similarly, when the second output 522(2) is connected to another device, a second reverse signal 554(2) may be coupled into the second output port 522(2). Since the first and second reverse signals 554(1), 554(2) propagate through the filtering power divider 500 in the opposite direction as the first and second output signals 552(1), 552(2), the filtering power divider 500 may combine some or all of each of the first and second reverse signals 554(1), 554(2) into a third reverse signal 560 that is outputted from the input port 520. Due to imperfect isolation between the first and second output ports 522(1), 522(2), some of the first reverse signal 554(1) may couple out of the second output port 522(2) as part of the second output signal 552(2). Similarly, some of the second reverse signal 554(2) may couple out of the first output port 522(1) as part of the first output signal 552(1).

Figure 8:
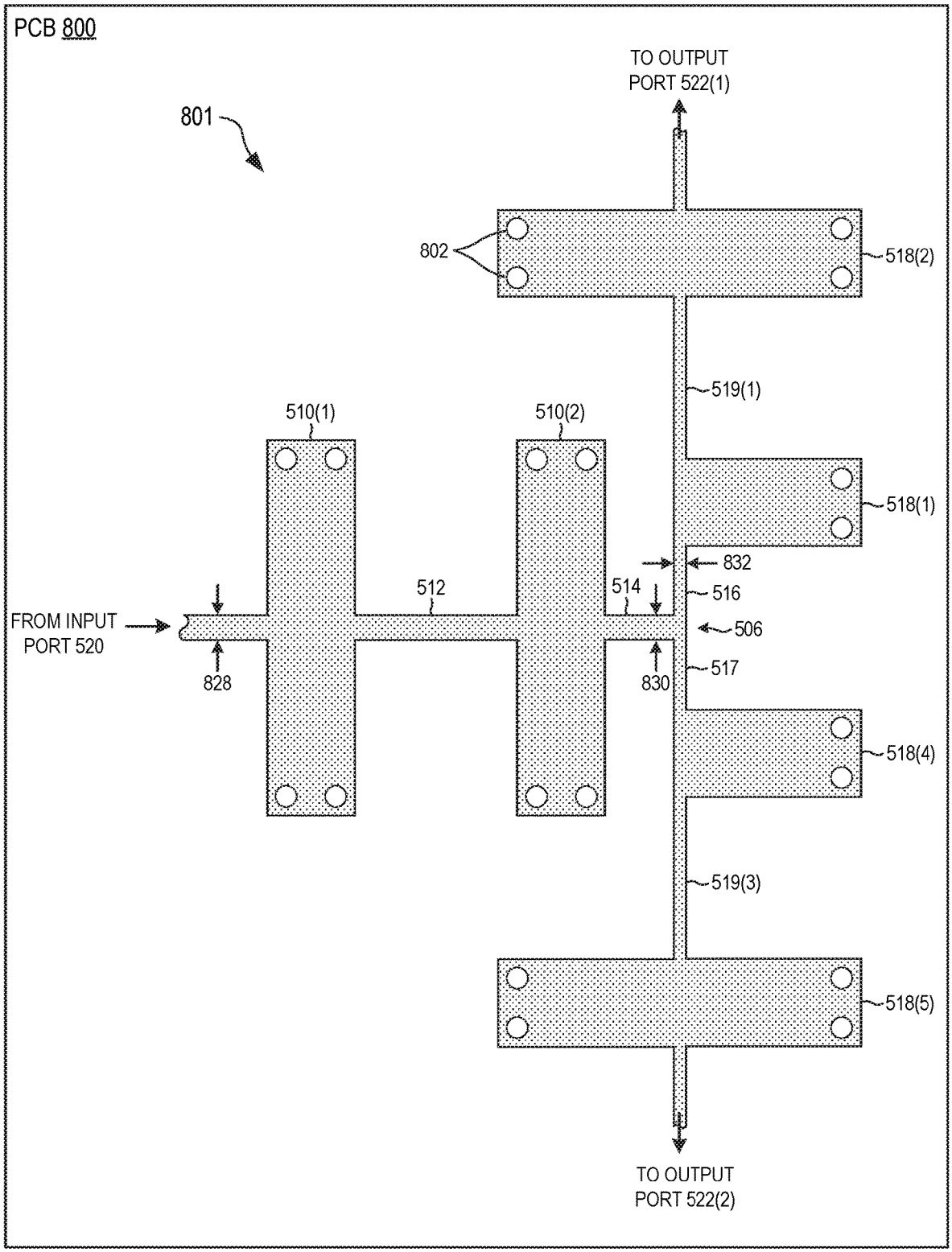
FIG. 8 shows a PCB with electrically conductive traces that implement the filtering power divider of FIG. 5, in an embodiment.
Figure 9:
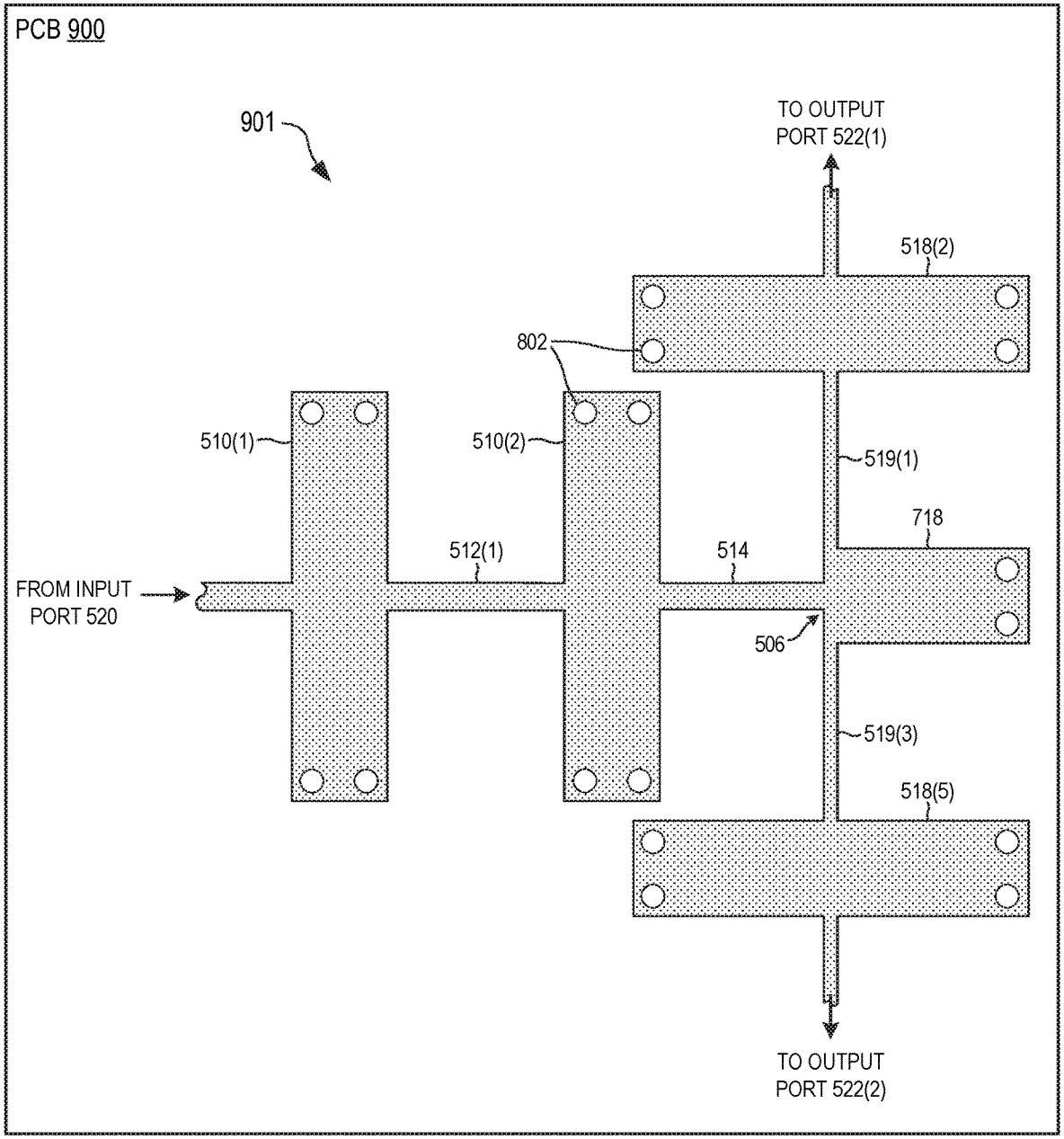
FIG. 9 shows a PCB with electrically conductive traces that implement the filtering power divider of FIG. 7, in an embodiment.
Figure 15:
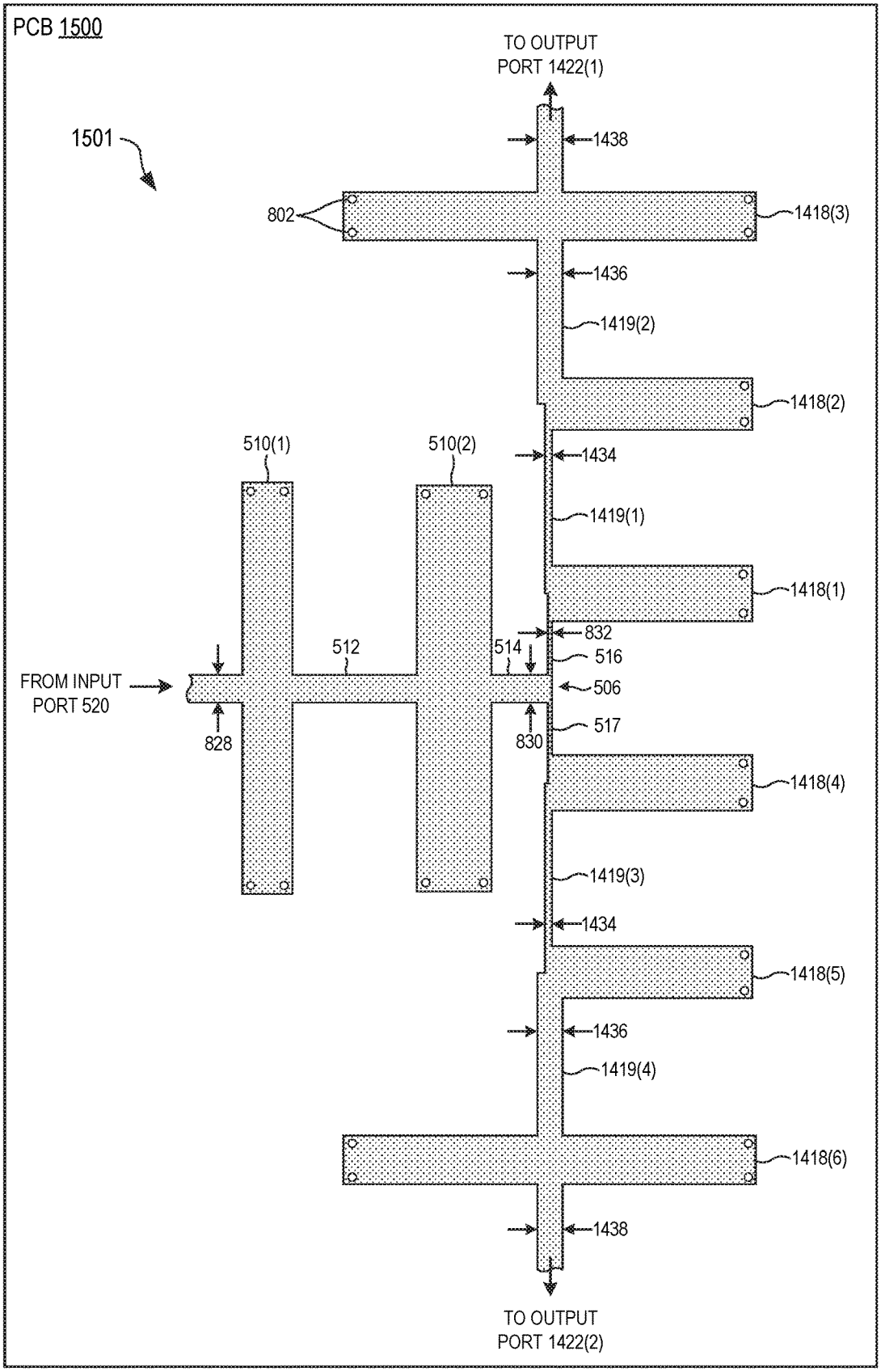
FIG. 15 shows a PCB with electrically conductive traces that implement the filtering power divider of FIG. 14, in an embodiment.

The filtering power divider 500 includes a T-junction 506 that connects a first partial transmission line 514 of the input stage 502 with a second partial transmission line 516 of the first output stage 504(1) and a third partial transmission line 517 of the second output stage 504(2). More specifically, the first partial transmission line 514 has a first end 507(1) and a second end 507(2), the second partial transmission line 516 has a first end 508(1) and a second end 508(2), and the third partial transmission line 517 has a first end 509(1) and a second end 509(2). Although not shown explicitly in FIG. 5, the first ends 507(1), 508(1), and 509(1) of the first, second, and third partial transmission lines 514, 516, 517 may directly connect with other to form the T-junction 506. Here, the term "directly connects" means without intervening electrical traces. Examples of how the first ends 507(1), 508(1), and 509(1) directly connect with each other to form the T-junction 506 are shown in FIGS. 8, 9, and 15.

To ensure impedance matching at the T-junction 506, a parallel impedance of the second and third partial transmission lines 516, 517 should equal a characteristic impedance of the first partial transmission line 514. For example, each of the first and second output ports 522(1), 522(2) may have an output impedance $Z_{out}$ that is twice an input impedance $Z_{in}$ of the input port 520. In this case, the second and third partial transmission lines 516, 517 will have the same characteristic impedance, wherein the input signal 550 is split equally between the second and third partial transmission lines 516, 517. However, the second and third partial transmission lines 516, 517 may have different characteristic impedances, wherein the input signal 550 is split unequally between the second and third partial transmission lines 516, 517.

To incorporate the bandpass filter 300 of FIG. 3 into the filtering power divider 500, the input stage 502 includes quarter-wave transmission lines 510(1), 512, and 510(2) that correspond to the quarter-wave transmission lines 310(1), 312(1), and 310(2), respectively, of FIG. 3. A characteristic impedance of each of the quarter-wave transmission lines 510(1), 512, 510(2) scales with the input impedance $Z_{in}$. The first output stage 504(1) includes quarter-wave transmission lines 518(1), 519(1), 518(2), 519(2), and 518(3) that correspond to the quarter-wave transmission lines 310(3), 312(3), 310(4), 312(4), and 310(5), respectively, of FIG. 3. Similarly, the second output stage 504(2) includes quarter-wave transmission lines 518(4), 519(3), 518(5), 519(4), and 518(6) that also correspond to the quarter-wave transmission lines 310(3), 312(3), 310(4), 312(4), and 310(5), respectively, of FIG. 3. A characteristic impedance of each of the quarter-wave transmission lines 518, 519 scales with the output impedance $Z_{out}$.

The filtering power divider 500 completes the bandpass filter 300 by splitting the series-connected quarter-wave transmission line 312(2) of FIG. 3 across the T-junction 506. Specifically, the first partial transmission line 514 has an electrical length $\theta_1$ at the center frequency $f_c$, and a characteristic impedance that scales with the input impedance $Z_{in}$. Each of the second and third partial transmission lines 516, 517 has an electrical length $\theta_2$ at the center frequency $f_c$, and a characteristic impedance that scales with the output impedance $Z_{out}$. A sum of the electrical lengths $\theta_1$ and $\theta_2$ equals 90°. Thus, the first partial transmission line 514 cooperates with the second partial transmission line 516 to form a quarter-wave transmission line that is functionally equivalent to the series-connected quarter-wave transmission line 312(2) of FIG. 3. With the partial transmission lines 514 and 516, the input stage 502 cooperates with the first output stage 504(1) to implement the Chebyshev bandpass filter 300 of FIG. 3 between the input port 520 and the first output port 522(1). The first partial transmission line 514 also cooperates with the third partial transmission line 517 of the second output stage 504(2) to form another quarter-wave transmission line that is functionally equivalent to the series-connected quarter-wave transmission line 312(2) of FIG. 3. Thus, the input stage 502 also cooperates with the second output stage 504(2) to implement the Chebyshev bandpass filter 300 of FIG. 3 between the input port 520 and the second output port 522(2).

As known by those trained in the art, the "electrical length" of a transmission line expresses the physical length of the transmission line in terms of the phase shift it imparts to a sine wave (at a particular frequency) propagating therethrough. All electrical lengths referred to herein are expressed in terms of a phase angle at a frequency $f_c$ of the sine wave. However, electrical lengths may be alternatively expressed as a multiple of a wavelength λ of the sine wave, corrected by a velocity factor of the transmission line.

In some embodiments, a resistor 562 may be used to increase isolation between the first and second output ports 522(1) and 522(2) when each of these ports is connected to an impedance-matched load. In the first output stage 504(1), the second partial transmission line 516 connects to the quarter-wave transmission lines 518(1) and 519(1) at a node 530(1). Similarly, the transmission lines 519(1), 518(2), and 519(2) connect at a node 530(2). The transmission lines 519(2) and 518(3) connect at a node 530(3) at which the first output port 522(1) occurs. The second output stage 504(2) has corresponding nodes 532, wherein the node 532(3) occurs at the second output port 522(2). The resistor 562 may be connected between one of the nodes 530 and the corresponding node 532. For example, the resistor 562 may be connected between the nodes 530(3) and 532(3) (i.e., between the first and second output ports 522(1) and 522(2)), as shown in FIG. 5. In this case, the resistor 562 helps prevent the first reverse signal 554(1) from coupling out of the second output port 522(2) as part of the second output signal 552(2). The resistor 562 also helps prevent the second reverse signal 554(2) from coupling out of the first output port 522(1) as part of the first output signal 552(1). A resistance of the resistor 562 is typically selected to equal a sum of the output impedances of the first and second output ports 522(1) and 522(2).

In some embodiments, the input stage 502 includes only the first partial transmission line 514, wherein the input port 520 coupled directly to the second end 507(2). Similarly, the first output stage 504(1) includes only the second partial transmission line 516, wherein the first output port 522(1) coupled directly to the second end 508(2), and the second output stage 504(2) includes only the third partial transmission line 517, wherein the second output port 522(2) coupled directly to the second end 509(2). When the resistor 562 is included in any of these embodiments, the resistor 562 connects between the second end 508(2) and the second end 509(2) to increase isolation therebetween.

Figure 6:
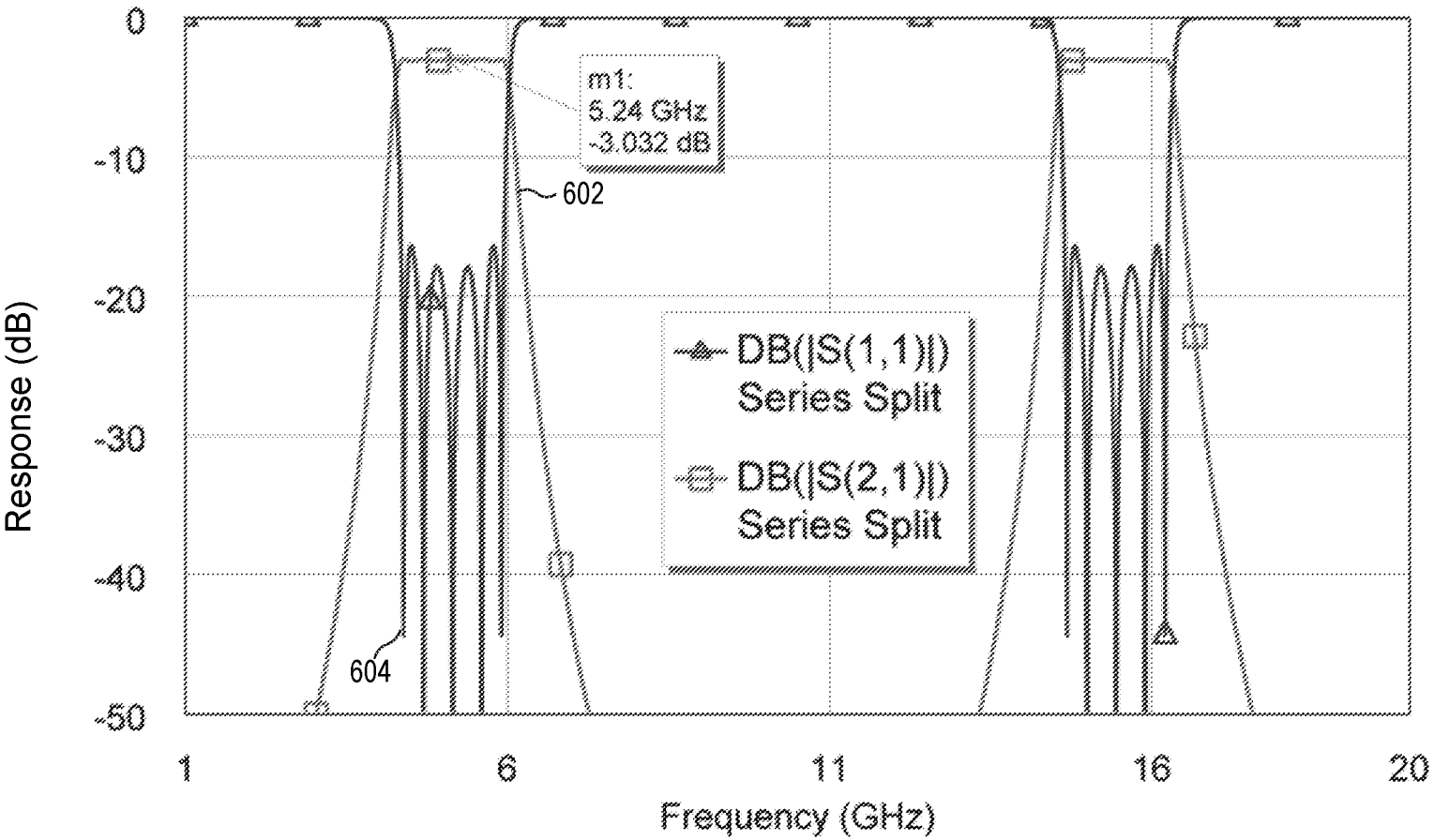
FIG. 6 is a plot showing transmission, as a function of frequency, between an input port and a first output port of the filtering power divider of FIG. 5.

FIG. 6 is a plot showing transmission 602, as a function of frequency, between the input port 520 and the first output port 522(1) of the filtering power divider 500 of FIG. 5. The plot also shows reflection 604, as a function of frequency, from the input port 520. The transmission 602 and reflection 604 were computed from a 3×3 S-matrix assuming the same filter characteristics used to generate the plot in FIG. 4. It was further assumed that: each transmission line 510, 512, 514, 516, 517, 518, and 519 is ideal; each partial transmission line 514, 516, and 517 has an electrical length of 45°; the input impedance is $Z_{in}$=50Ω; the output impedance is $Z_{out}$=100Ω at each of the output ports 522; the ports 520, 522(1), and 522(2) are properly impedance-matched; and the partial transmission lines 516 and 517 have the same characteristic impedance so that the input signal 550 is split equally between the output ports 522(1) and 522(2).

In FIG. 6, the transmission 602 is the magnitude of the off-diagonal element of the S-matrix (i.e., $|S_{1,2}|$), and the reflection 604 is the magnitude of the first diagonal element of the S-matrix (i.e., $|S_{1,1}|$). The transmission 602 near the center frequency $f_c$ is approximately −3 dB, as expected for a lossless 1:2 power splitter. Other features of the transmission 602 and reflection 604 match the transmission 402 and reflection 404 of FIG. 4, thereby demonstrating that the filtering power divider 500 implements the five-stage Chebyshev filter 300 of FIG. 3 between the input port 520 and the first output port 522(1). Although not shown explicitly in FIG. 6, the transmission $|S_{1,3}|$ of the filtering power divider 500 between the input port 520 and the second output port 522(2) is similar to the transmission 602.

The normalized impedances Z of the transmission lines 510, 512, 514, 516, 517, 518, and 519 are the same as those in Table 1. The characteristic impedances Z of the transmission lines 510, 512, and 514 are the same as those for the transmission lines 310 and 312 of FIG. 3 (see Table 1) since the input impedance $Z_{in}$ in FIG. 5 and the system impedance $Z_0$ of FIG. 3 are the same (i.e., 50Ω). However, the impedances of the transmission lines 516, 517, 518, and 519 are different than those in Table 1 since $Z_{out} \neq Z_{in}$. Table 2 below lists the characteristic impedances for the transmission lines 510, 512, 514, 516, 517, 518, and 519.

TABLE 2

Exemplary Impedances for the Transmission Lines 510, 512, 514, 516, 518, and 519 of the Filtering Power Divider 500

| Transmission Line Identifier | Normalized Impedance | Port Impedance | Transmission-Line Impedance |
|---|---|---|---|
| 510(1) | $\tilde{Z}_1 = 1/\tilde{Y}_1 = 0.2029$ | $Z_{in} = 50\Omega$ | $Z_1 = \tilde{Z}_1 Z_{in} = 10.15\Omega$ |
| 512 | $\tilde{Z}_{1,2} = 1/\tilde{Y}_{1,2} = 1.1940$ | $Z_{in} = 50\Omega$ | $Z_{1,2} = \tilde{Z}_{1,2} Z_{in} = 59.70\Omega$ |
| 510(2) | $\tilde{Z}_2 = 1/\tilde{Y}_2 = 0.2783$ | $Z_{in} = 50\Omega$ | $Z_2 = \tilde{Z}_2 Z_{in} = 13.92\Omega$ |
| 514 | $\tilde{Z}_{2,3} = 1/\tilde{Y}_{2,3} = 1.6778$ | $Z_{in} = 50\Omega$ | $Z_{2,3}^{(1)} = \tilde{Z}_{2,3} Z_{in} = 83.89\Omega$ |
| 516, 517 | $\tilde{Z}_{2,3} = 1/\tilde{Y}_{2,3} = 1.6778$ | $Z_{out} = 100\Omega$ | $Z_{2,3}^{(2)} = \tilde{Z}_{2,3} Z_{out} = 167.78\Omega$ |
| 518(1), 518(4) | $\tilde{Z}_3 = 1/\tilde{Y}_3 = 0.2607$ | $Z_{out} = 100\Omega$ | $Z_3 = \tilde{Z}_3 Z_{out} = 26.07\Omega$ |
| 519(1), 519(3) | $\tilde{Z}_{3,4} = 1/\tilde{Y}_{3,4} = 1.6778$ | $Z_{out} = 100\Omega$ | $Z_{3,4} = \tilde{Z}_{3,4} Z_{out} = 167.78\Omega$ |
| 518(2), 518(5) | $\tilde{Z}_4 = 1/\tilde{Y}_4 = 0.2783$ | $Z_{out} = 100\Omega$ | $Z_4 = \tilde{Z}_4 Z_{out} = 27.83\Omega$ |
| 519(2), 519(4) | $\tilde{Z}_{4,5} = 1/\tilde{Y}_{4,5} = 1.1940$ | $Z_{out} = 100\Omega$ | $Z_{4,5} = \tilde{Z}_{4,5} Z_{out} = 119.40\Omega$ |
| 518(3), 518(6) | $\tilde{Z}_5 = 1/\tilde{Y}_5 = 0.2029$ | $Z_{out} = 100\Omega$ | $Z_5 = \tilde{Z}_5 Z_{out} = 20.29\Omega$ |

As indicated Table 2, the partial transmission lines 514, 516, and 517 have the same normalized impedance, and thus each of the second and third partial transmission lines 516, 517 has twice the impedance of the first partial transmission line 514 (i.e., $$Z_{2,3}^{(2)} = 2Z_{2,3}^{(1)}).$$

While the filtering power divider 500 is shown in FIG. 5 with the second series-connected transmission line split across the T-junction 506, the filtering power divider 500 may be implemented such that a different series-connected transmission line is split across the T-junction 506. For example, the T-junction 506 may be placed such that the partial transmission lines 514, 516, 517 cooperate to function equivalently to the series-connected transmission line 519(1), wherein the characteristic impedances of all transmission lines are adjusted accordingly. Such alternative configurations are equivalent to the input stage 502 having more or fewer filtering stages, and the output stages 504 having more or fewer filtering stages.

Figure 7:
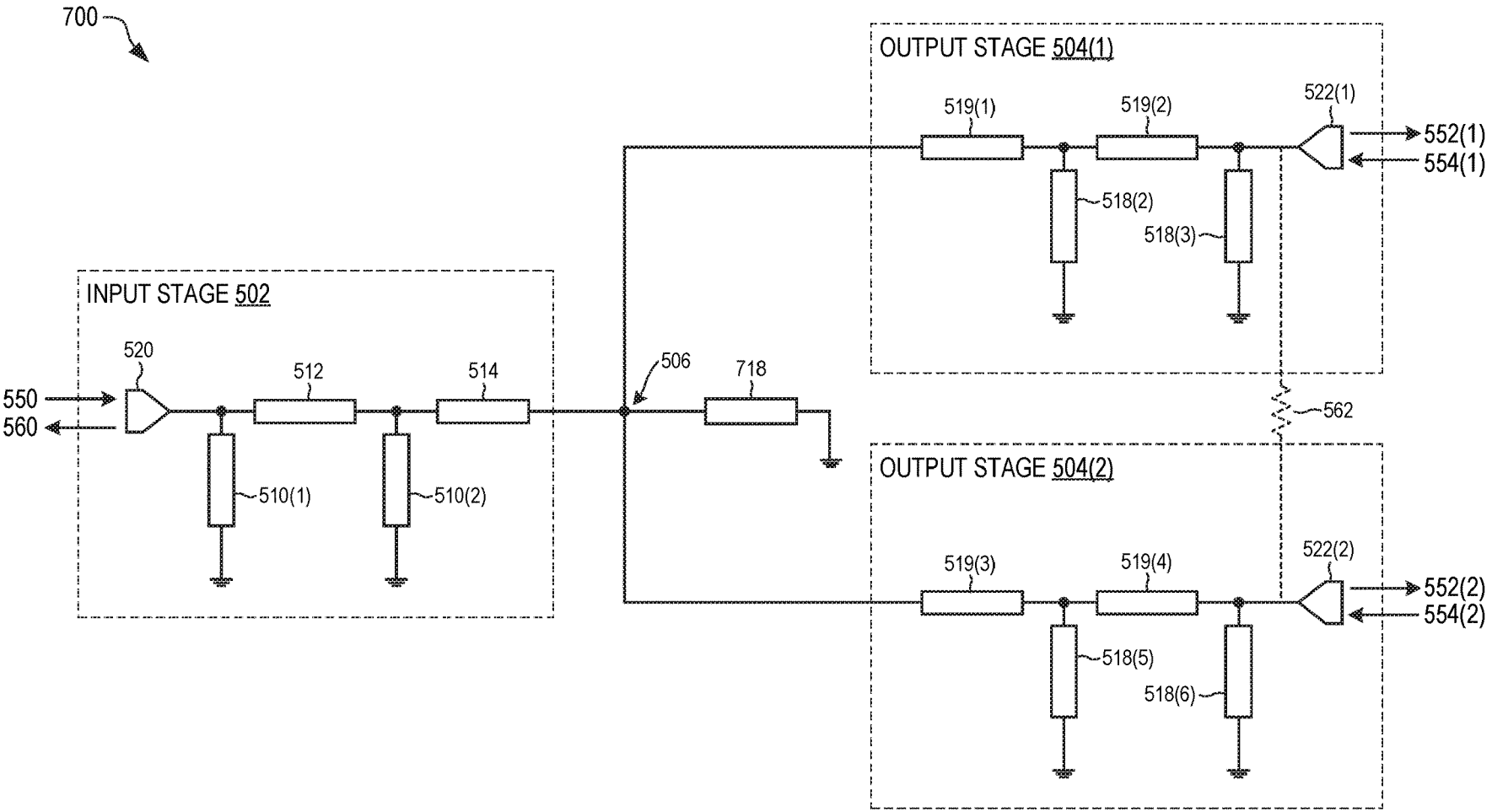
FIG. 7 is a schematic diagram of a filtering power divider that is similar to the filtering power divider of FIG. 5, in an embodiment.

FIG. 7 is a schematic diagram of a filtering power divider 700 that is similar to the filtering power divider 500 of FIG. 5 except that the first partial transmission line 514 has an electrical length of 90° (at a center frequency $f_c$), and therefore the second and third partial transmission lines 516 and 517 are excluded. In addition, the quarter-wave transmission lines 518(1) and 518(4) of FIG. 5 are combined into a single quarter-wave transmission line 718 that advantageously saves space. A characteristic impedance of the quarter-wave transmission line 718 scales with the input impedance $Z_{in}$. The filtering power divider 700 performs similarly to the filtering power divider 500, as shown in FIG. 6.

While the filtering power divider 700 is shown in FIG. 7 with the T-junction 506 located between the series-connected transmission lines 514 and 519(1), the T-junction 506 may be located between a different pair of series-connected transmission lines. For example, the T-junction 506 may be placed between the series-connected transmission line 519 (1) and 519(2), wherein the characteristic impedances of the transmission lines are adjusted accordingly. Such alternative configurations are equivalent to the input stage 502 having more or fewer filtering stages, and the output stages 504 having more or fewer filtering stages.

FIG. 8 shows a PCB 800 with electrically conductive traces 801 that implement the filtering power divider 500 of FIG. 5. The traces 801 are shown in FIG. 8 as microstrip transmission lines, wherein a dielectric layer insulates the traces 801 from an underlying (or overlaying) ground plane. The quarter-wave transmission lines 510 and 518 are grounded to the ground plane through vias 802. For clarity in FIG. 8, only some of the vias 802 are labeled. Also for clarity, the transmission lines 519(2), 519(4), 518(3), and 518(6) are not shown. While FIG. 8 shows the traces 801 as microstrip transmission lines, the filtering power divider 500 may be implemented using another type of planar transmission line, such as fin slot, finline, stripline, coplanar waveguide (CPW), or grounded CPW. Alternatively, the filtering power divider 500 may be implemented with non-planar transmission lines, such as coaxial transmission lines.

In FIG. 8, a width of each transmission line 510, 512, 514, 516, 517, 518, and 519 decreases as its characteristic impedance increases. For example, a width 828 is selected such that the input port 520 has the input impedance $Z_0$. Since the first partial transmission line 514 has an impedance that is one-half that of the second partial transmission line 516, a width 830 of the first partial transmission line 514 is larger than a width 832 of the second partial transmission line 516. While FIG. 8 shows each of the transmission lines 510(1), 510(2), and 518(1) as a double-stub, each of these transmission lines may be alternatively implemented as a single stub. Similarly, while FIG. 8 shows each of the transmission lines 518(1) and 518(4) as a single stub, each of these transmission lines may be alternatively implemented as a double stub, provided there is room on the printed circuit board.

In FIG. 8, the first partial transmission line 514 is oriented perpendicularly to each of the second and third partial transmission lines 516, 517 (i.e., the second and third partial transmission lines 516, 517 are parallel to each other). In this case, the first, second, and third partial transmission lines 514, 516, 517 are configured as a "tee". However, the first, second, and third partial transmission lines 514, 516, 517 may form different angles therebetween without departing from the scope hereof. Accordingly, the term "T-junction" (e.g., the T-junction 506) is not limited to the perpendicular orientation shown in FIG. 8.

FIG. 9 shows a PCB 900 with electrically conductive traces 901 that implement the filtering power divider 700 of FIG. 7. Here, the single quarter-wave transmission line 718 is implemented as a single stub that directly connects to the T-junction 506. While FIG. 9 shows the traces 901 as microstrip transmission lines, the filtering power divider 900 may be implemented using another type of planar transmission line, such as fin slot, finline, stripline, coplanar waveguide (CPW), or grounded CPW. Alternatively, the filtering power divider 900 may be implemented with non-planar transmission lines, such as coaxial transmission lines.

Impedance Transformer

Figure 10:
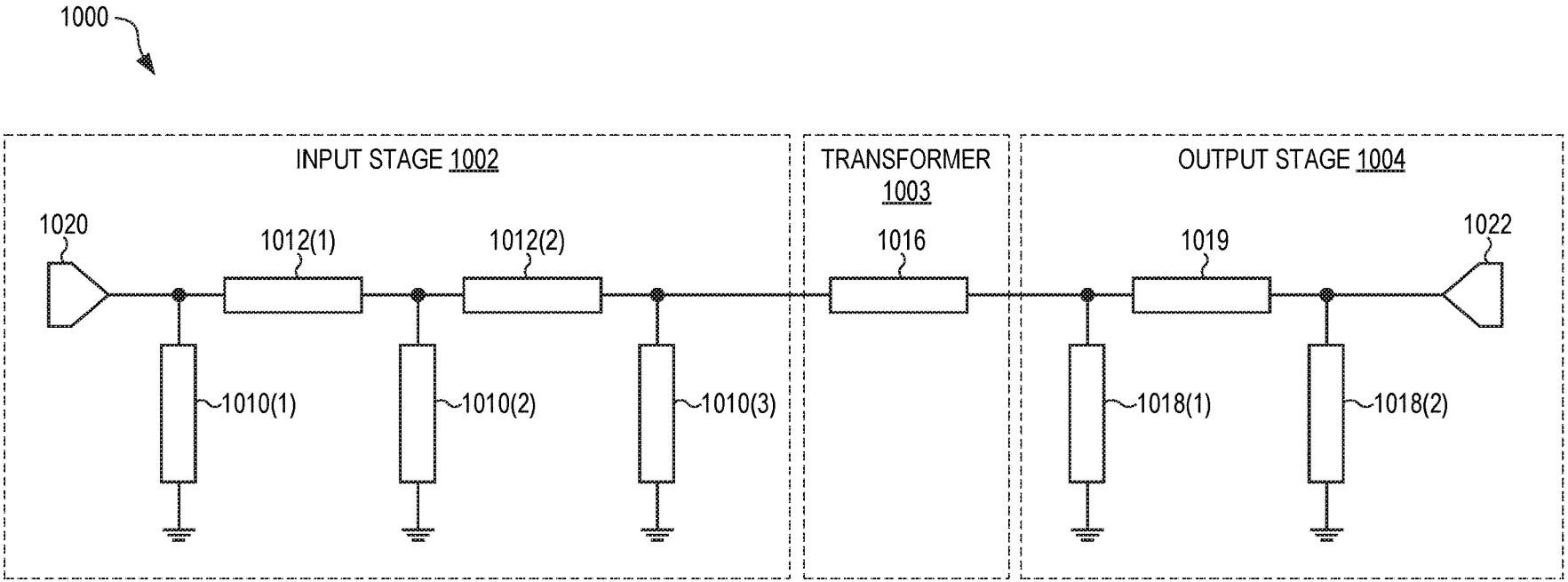
FIG. 10 is a schematic diagram of a two-port bandpass filter that advantageously operates with different impedances at its two ports, in embodiments.

FIG. 10 is a schematic diagram of a two-port bandpass filter 1000 that advantageously operates with different impedances at its two ports. The two-port bandpass filter 1000 is shown in FIG. 10 as a five-stage Chebyshev filter with an input port 1020 having an input impedance $Z_{in}$ and an output port 1022 having an output impedance $Z_{out} \neq Z_{in}$. The two-port bandpass filter 1000 has an input stage that includes transmission lines 1010(1), 1012(1), 1010(2), 1012 (2), and 1010(3) that correspond to transmission lines 310 (1), 312(1), 310(2), 312(2), and 310(3), respectively, of FIG. 3. A characteristic impedance of each of the transmission lines 1010(1), 1012(1), 1010(2), 1012(2), and 1010(3) scales with the input impedance $Z_{in}$. The two-port bandpass filter 1000 also has an output stage 1004 that includes transmission lines 1018(1), 1019, and 1018(2) that correspond to transmission lines 310(4), 312(4), and 310(5), respectively, of FIG. 3. A characteristic impedance of each of the transmission lines 1018(1), 1019, and 1018(2) scales with the output impedance $Z_{out}$.

To transition between the input and output impedances, the two-port bandpass filter 1000 also has an impedance transformer 1003 that includes a transmission line 1016 that corresponds to the transmission line 312(3) of FIG. 3. The intermediate impedance $Z_i$ of the impedance transformer 1003 is selected to be the geometric mean of $Z_{in}$ and $Z_{out}$, i.e., $Z_i=(Z_{in}Z_{out})^{1/2}$.

Figure 11:
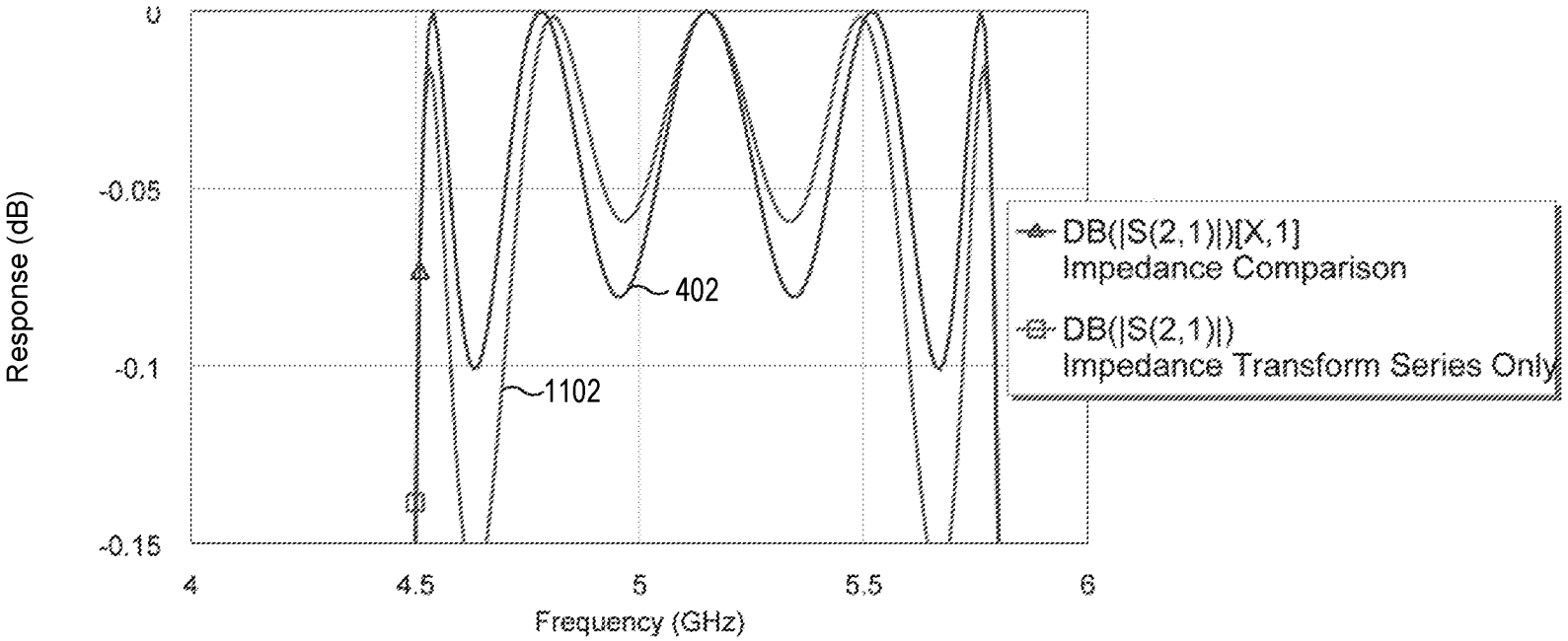
FIG. 11 is a plot comparing transmission, as a function of frequency, of the two-port bandpass filter of FIG. 10 with the transmission of the two-port bandpass filter of FIG. 3.

FIG. 11 is a plot comparing transmission 1102, as a function of frequency, of the two-port bandpass filter 1000 with the transmission 402 of the two-port bandpass filter 300 of FIG. 3. For clarity, the plot only shows the transmissions 1102 and 402 in the passband of the filters. The transmissions 1102 and 402 agree to within a few tenths of a dB in the passband, and therefore the bandpass filter 1000 well approximates the response of the bandpass filter 300. The transmission 1102 was calculated with the same filter characteristics and assumptions used to calculate the transmission 402, and therefore with the same normalized impedances in Table 1. Further assuming $Z_{in}=50\Omega$ and $Z_{out}=100\Omega$, the intermediate impedance $Z_i$ is 70.7Ω. The impedance $Z_{3,4}$ of the transmission line 1016 is obtained by multiplying its normalized impedance $\tilde{Z}_{3,4}=1/\tilde{Y}_{3,4}$ by the intermediate impedance $Z_i$, i.e., $\tilde{Z}_{3,4}=\tilde{Z}_{3,4}Z_i=Z_i/\tilde{Y}_{3,4}$.

Figure 12:
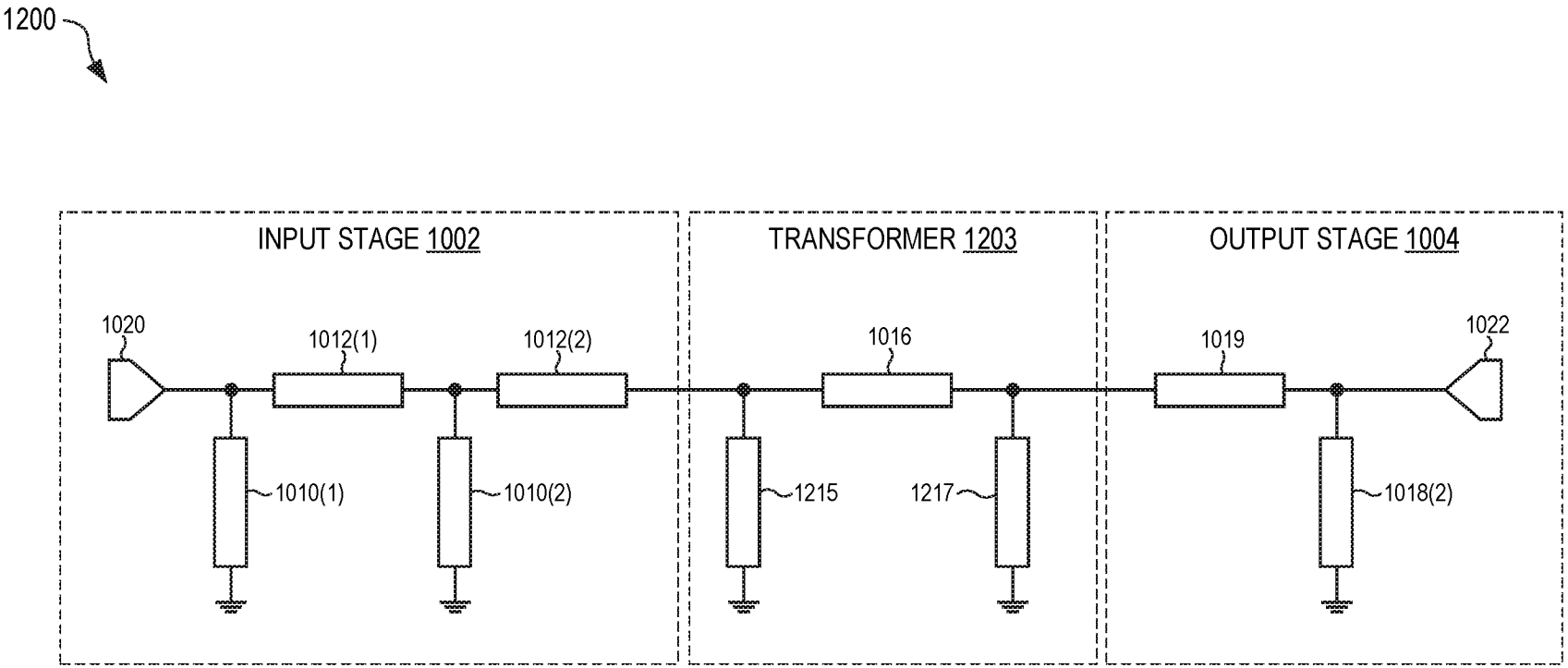
FIG. 12 is schematic diagram of a two-port bandpass filter that has different input and output impedances, and a response that more closely matches the bandpass filter of FIG. 3 than the bandpass filter of FIG. 10, in embodiments.

FIG. 12 is schematic diagram of a two-port bandpass filter 1200 that has different input and output impedances, and a response that more closely matches the bandpass filter 300 of FIG. 3 than the bandpass filter 1000 of FIG. 10. The bandpass filter 1200 is similar to the bandpass filter 1000 of FIG. 10 except that the bandpass filter 1200 has an impedance transformer 1203 that includes shunted quarter-wave transmission lines 1215 and 1217. In addition, the bandpass filter 1200 excludes shunted transmission lines 1010(3) and 1018(1). The following procedure may be used to determine characteristic impedances Z of the transmission lines 1010, 1012, 1016, 1018, 1019, 1215, and 1217:

(1) Use the synthesis equations (e.g., see Eqns. 1) to derive normalized admittances $\tilde{Y}$ for the transmission lines 1010, 1012, 1016, 1018, 1019, 1215, and 1217 under the assumption of equal input and output impedances.

(2) Divide the normalized admittance $\tilde{Y}_{2,3}$ of the transmission line 1012(2) by $Z_{in}$ to obtain the admittance $\tilde{Y}_{2,3}^{(in)}=\tilde{Y}_{2,3}/Z_{in}$ scaled to the input impedance $Z_{in}$.

(3) Divide the normalized admittance $\tilde{Y}_{4,5}$ of the transmission line 1019 by $Z_{out}$ to obtain the admittance $Y_{4,5}^{(out)}=\tilde{Y}_{4,5}/Z_{out}$ scaled to the output impedance $Z_{out}$.

(4) Divide the normalized admittance $\tilde{Y}_{3,4}$ of the transmission line 1016 by $Z_i$ to obtain the admittance $Y_{3,4}^{(i)}=\tilde{Y}_{3,4}/Z_i$ scaled to the intermediate impedance $Z_i$. Invert the admittance $Y_{3,4}^{(i)}$ to obtain the characteristic impedance $Z_{3,4}=1/Y_{3,4}^{(i)}$ of the transmission line 1016.

(5) Calculate the admittance $\tilde{Y}_3^{(in)}$ of the transmission line 1215, normalized to the input impedance $Z_{in}$, according to:

$$\tilde{Y}_3^{(in)} = h\Omega_c - (Y_{2,3}^{(in)} + Y_{3,4}^{(i)})Z_{in}, \tag{2}$$

where the factor $Z_{in}$ normalizes the term in parentheses to $Z_{in}$. Scale the normalized admittance $\tilde{Y}_3^{(in)}$ by $Z_{in}$ to obtain the characteristic impedance $Z_3$ of the transmission line 1215.

(6) Calculate the admittance $\tilde{Y}^{(out)}$ of the transmission line 1217, normalized to the output impedance $Z_{out}$, according to:

$$\tilde{Y}_4^{(out)} h\Omega - (Y_{3,4}^{(i)} + Y_{4,5}^{(out)})Z_{out}, \tag{3}$$

where the factor $Z_{out}$ normalizes the term in parentheses to $Z_{out}$. Scale the normalized admittance $\tilde{Y}_4^{(out)}$ by $Z_{out}$ to obtain the characteristic impedance $Z_4$ of the transmission line 1217.

(7) Scale the normalized admittances $\tilde{Y}$ from step 1 by the input impedance $Z_{in}$ to obtain the characteristic impedances Z for the transmission lines 1010 and 1012 of the input stage 1002.

(8) Scale the normalized admittances $\tilde{Y}$ from step 1 by the output impedance $Z_{out}$ to obtain the characteristic impedances Z for the transmission lines 1018 and 1019 of the output stage 1004.

Table 3 below lists the impedances Z for the two-port bandpass filter 1200 assuming the same filter characteristics and assumptions used for Tables 1 and 2.

TABLE 3

Exemplary Impedances for the Transmission Lines 1010, 1012, 1016, 1019, 1018, 1215, and 1217 of the Two-Port Bandbass Filter 1200

| Transmission Line Identifier | Normalized Impedance | Impedance Scaling | Transmission-Line Impedance |
|---|---|---|---|
| 1010(1) | $\tilde{Z}_1 = 1/\tilde{Y}_1 = 0.2029$ | $Z_{in} = 50\Omega$ | $Z_1 = \tilde{Z}_1 Z_{in} = 10.15\Omega$ |
| 1012(1) | $\tilde{Z}_{1,2} = 1/\tilde{Y}_{1,2} = 1.1940$ | $Z_{in} = 50\Omega$ | $Z_{1,2} = \tilde{Z}_{1,2} Z_{in} = 59.70\Omega$ |
| 1010(2) | $\tilde{Z}_2 = 1/\tilde{Y}_2 = 0.2783$ | $Z_{in} = 50\Omega$ | $Z_2 = \tilde{Z}_2 Z_{in} = 13.92\Omega$ |
| 1012(2) | $\tilde{Z}_{2,3} = 1/\tilde{Y}_{2,3} = 1.6778$ | $Z_{in} = 50\Omega$ | $Z_{2,3} = \tilde{Z}_{2,3} Z_{in} = 83.89\Omega$ |
| 1215 | See Eqn. 2 | $Z_{in} = 50\Omega$ | $Z_3 = Z_{in}/\tilde{Y}_3^{(in)} = 12.47\Omega$ |
| 1016 | $\tilde{Z}_{3,4} = 1/\tilde{Y}_{3,4} = 1.6778$ | $Z_i = 7.7\Omega$ | $Z_{3,4} = \tilde{Z}_{3,4} Z_i = 118.64\Omega$ |
| 1217 | See Eqn. 3 | $Z_{out} = 100\Omega$ | $Z_4 = Z_{out}/\tilde{Y}_4^{(out)} = 29.89\Omega$ |
| 1019 | $\tilde{Z}_{4,5} = 1/\tilde{Y}_{4,5} = 1.1940$ | $Z_{out} = 100\Omega$ | $Z_{4,5} = \tilde{Z}_{4,5} Z_{out} = 119.40\Omega$ |
| 1018(2) | $\tilde{Z}_5 = 1/\tilde{Y}_5 = 0.2029$ | $Z_{out} = 100\Omega$ | $Z_5 = \tilde{Z}_5 Z_{out} = 20.29\Omega$ |

Figure 13:
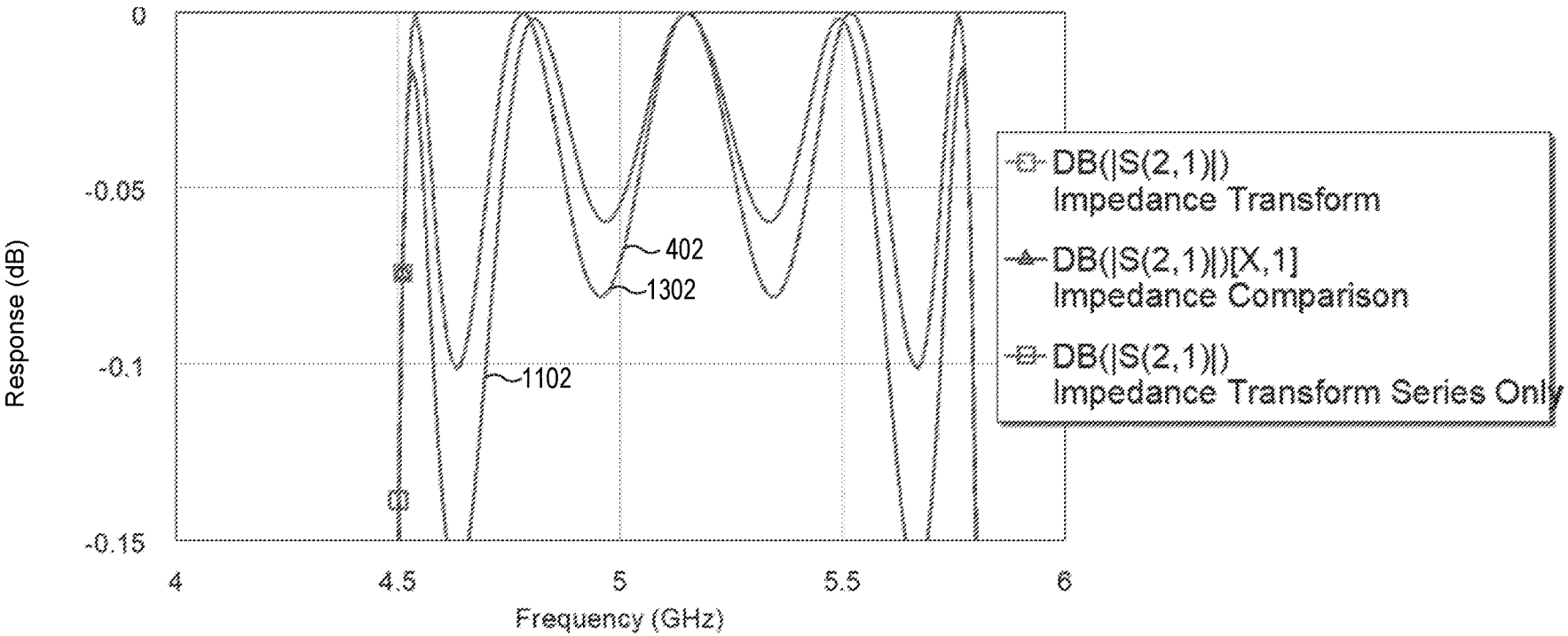
FIG. 13 is a plot comparing transmission, as a function of frequency, of the bandpass filter of FIG. 12 with the transmission of the bandpass filter of FIG. 3.

FIG. 13 is a plot comparing transmission 1302, as a function of frequency, of the bandpass filter 1200 with the transmission 402 of the bandpass filter 300 of FIG. 3. Mathematically, the transmissions 1302 and 402 are identical, and thus overlap exactly in the plot. For comparison, the plot also includes the transmission 1102 of the bandpass filter 1000.

Filtering Power Divider with Integrated Impedance Transformers

Figure 14:
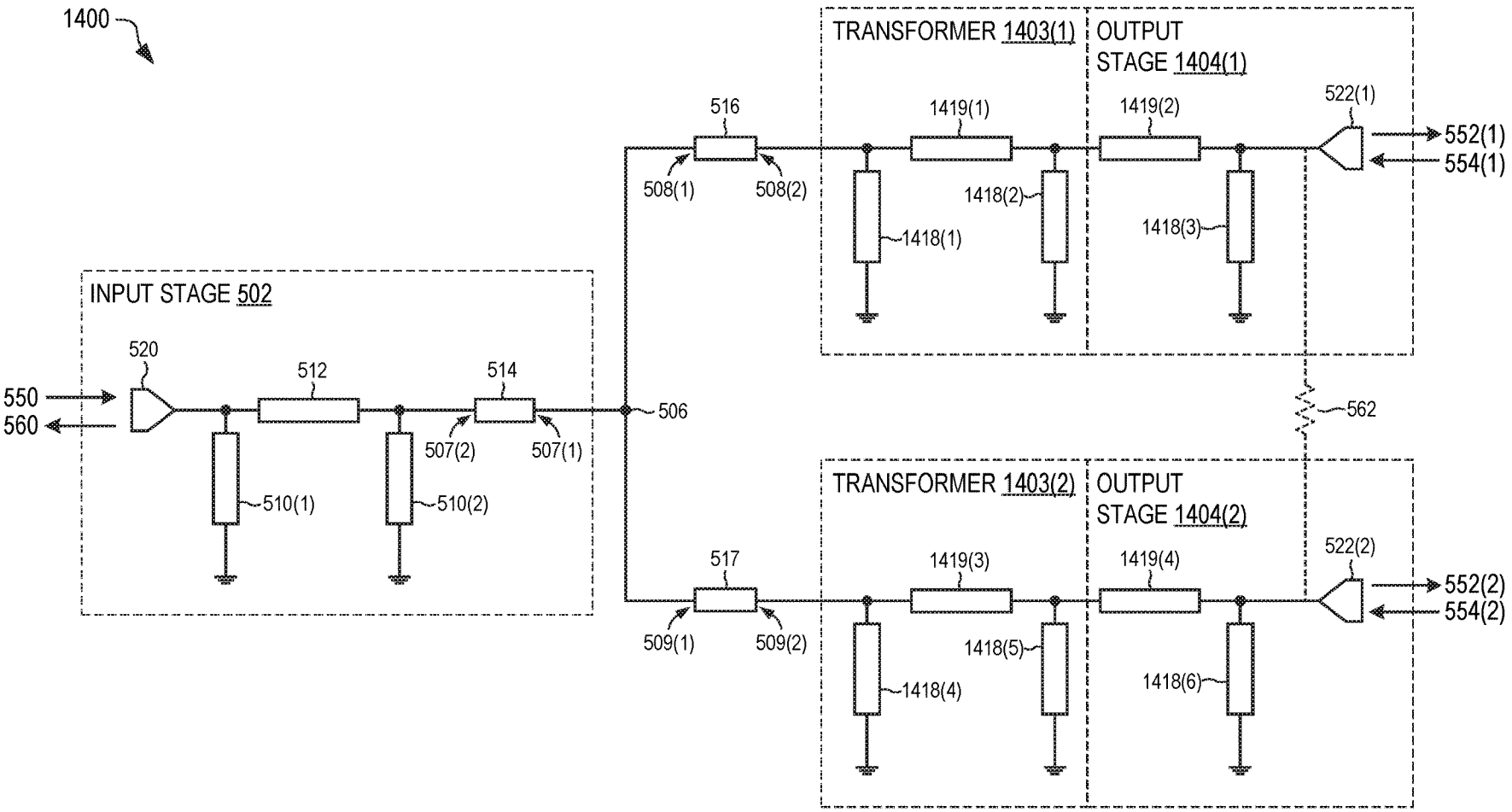
FIG. 14 is a schematic diagram of a filtering power divider that integrates two impedance transformers into the filtering power divider of FIG. 5, in embodiments.

FIG. 14 is a schematic diagram of a filtering power divider 1400 that integrates two of the impedance transformer 1403 into the filtering power divider 500 of FIG. 5. The filtering power divider 1400 may replace any or all of the power dividers 102 of FIG. 1 to advantageously add filtering to the corporate power divider 100. Accordingly, a filtering corporate power splitter may be formed by cascading a plurality of any of the filtering power divider embodiments described herein (i.e., the filtering the filtering power divider 500 of FIG. 5, the filtering power divider 700 of FIG. 7, and the filtering power divider 1400).

A first impedance transformer 1403(1) includes quarter-wave transmission lines 1418(1), 1419(1), and 1418(2) that replace the transmission lines 518(1), 519(1), and 518(2), respectively, of FIG. 5. In addition, a second impedance transformer 1403(2) includes quarter-wave transmission lines 1418(4), 1419(3), and 1418(5) that replace the transmission lines 518(4), 519(3), and 518(5), respectively, of FIG. 5. Advantageously, characteristic impedances of the transmission lines 1418 and 1419 can be selected such that the output impedance of each of the output ports 522 is a value other than twice the input impedance. In fact, when these characteristic impedances are selected such that each output impedance is less than twice the input impedance (e.g., equal to the input impedance), several of the power divider 1400 may be cascaded to form the corporate power splitter 100 of FIG. 1 without the output impedances growing so large that the transmission-line widths cannot be reliably fabricated. The filtering power divider 1400 also implements the impedance transformers 1403 with no additional components (e.g., additional quarter-wave transmission lines). Similar to the filtering power divider 1400 of FIG. 5, a resistor may be placed between a node of the first transformer 1403(1) or first output stage 1404(1), and a corresponding node of the second transformer 1403(2) or second output stage 1404(1), to increase isolation between the first and second output ports 522(1) and 522(2).

To determine the characteristic impedances of the transmission lines in FIG. 14, the procedure described above for FIG. 5 may be used to determine the characteristic impedance of the second partial transmission line 516. The characteristic impedance of the transmission line 1419(1) may then be obtained using step 4 of the procedure outlined above for FIG. 12, wherein the intermediate impedance is the geometric mean of (1) a nominal impedance $Z_s$ seen by the first end 508(1) of the second partial transmission line 516, and (2) the output impedance, or $Z_i=(Z_sZ_{out})^{1/2}$. For the case of equal-power splitting, the nominal impedance $Z_s$ is twice the input impedance $Z_{in}$, and therefore $Z_i=(2Z_{in}Z_{out})^{1/2}$. However, for unequal power splitting, the value of $Z_s$ used to determine the characteristic impedance of the transmission line 1419(1) may be different than that used to determine the characteristic impedance of the transmission line 1419(3).

The admittance of the transmission line 1418(1) may then be determined from the admittances of the transmission lines 516 and 1419(1), similar to step 5 in the procedure outlined above for FIG. 12. Similarly, the admittance of the transmission line 1418(2) may be determined from the admittances of the transmission lines 1419(1) and 1419(2), similar to step 6 in the procedure outlined above for FIG. 12. This procedure may then be repeated to obtain the characteristic impedances of the transmission lines 517, 1419(3), 1418(4), and 1418(5).

FIG. 15 shows a PCB 1500 with electrically conductive traces 1501 that implement the filtering power divider 1400 of FIG. 14. In FIG. 15, each impedance transformer 1403 reduces the impedance such that the output impedance $Z_{out}$ equals the input impedance $Z_{in}$. Like the example of FIG. 8, a width 830 of the first partial transmission line 514 is larger than a width 832 of the second and third partial transmission lines 516, 517. Each of the transmission lines 1419(1) and 1419(3) has a width 1434 that may be slightly larger than the width 832 since the characteristic impedance of these transmission lines scales with the intermediate impedance $Z_{in}$, which is less than $2Z_0$. Similarly, a width 1436 of each of the transmission lines 1419(2) and 1419(4), and a width 1438 of each of the output ports 1422(1) and 1422(2), may be even larger, in accordance with the further reduction in impedance. In the example of FIG. 15, where $Z_{in}=Z_{out}$, the widths 1438 and 828 are equal. While FIG. 15 shows the traces 1501 as microstrip transmission lines, the filtering power divider 1400 may be implemented using another type of planar transmission line, such as fin slot, finline, stripline, coplanar waveguide (CPW), or grounded CPW. Alternatively, the filtering power divider 1400 may be implemented with non-planar transmission lines, such as coaxial transmission lines.

Test Results

A first prototype corporate power splitter was fabricated and operated with a four-element antenna array 108. The first prototype used three of the filtering power dividers 1400 of FIG. 14, and thus was similar to the corporate power splitter 100 of FIG. 1. The first prototype splitter implemented a seven-stage Chebyshev bandpass filter at a center frequency of $f_c \approx 2$ GHz using microstrip-based quarter-wave transmission lines. Filter stages were distributed across the T-junctions such that the first prototype implemented the seven-stage Chebyshev bandpass filter between a 50Ω input port and each of four 80Ω output ports.

Figure 16:
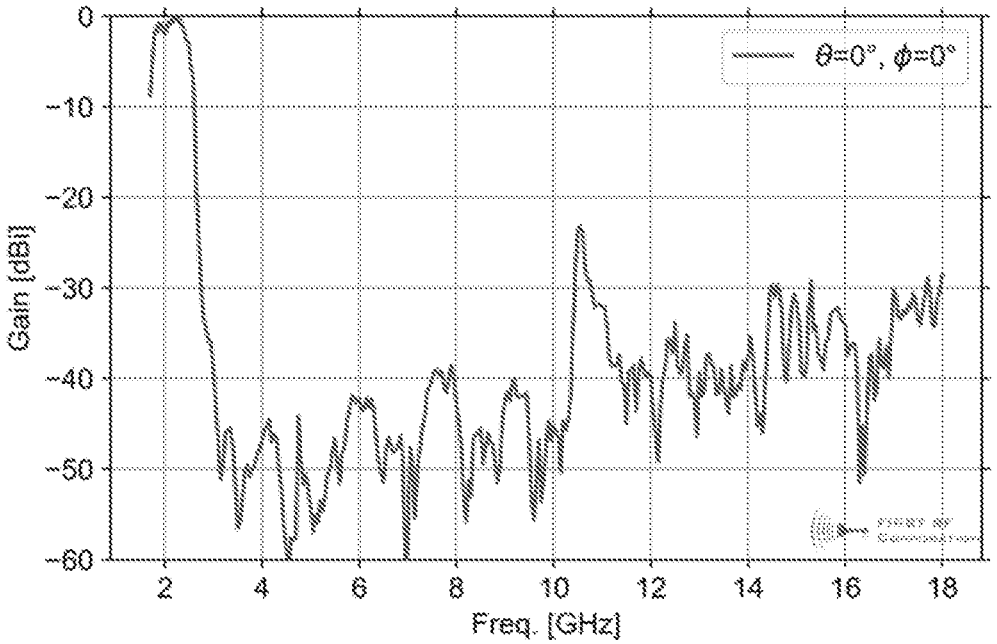
FIG. 16 is a plot of gain versus frequency of an antenna array when fed by a first prototype corporate power splitter.

FIG. 16 is a plot of gain versus frequency of the antenna array 108 when fed by the first prototype corporate power splitter. The data in FIG. 16 was measured with a probe antenna that was placed in front of the antenna array 108 to measure the electromagnetic field emitted by the antenna array 108 in its forward direction. The first prototype included an additional low-pass filter to block transmission of signals at the odd harmonics of the center frequency $f_c$. The gain is normalized to its peak value near $f_c$.

A second prototype corporate power splitter was fabricated and operated with a four-element antenna array 108 at a center frequency of $f_c \approx 5.15$ GHz using microstrip-based quarter-wave transmission lines. Filter stages were distributed across one T-junction such that the second prototype implemented a five-stage Chebyshev bandpass filter between a 50Ω input port and each of four 50Ω output ports.

Figure 17:
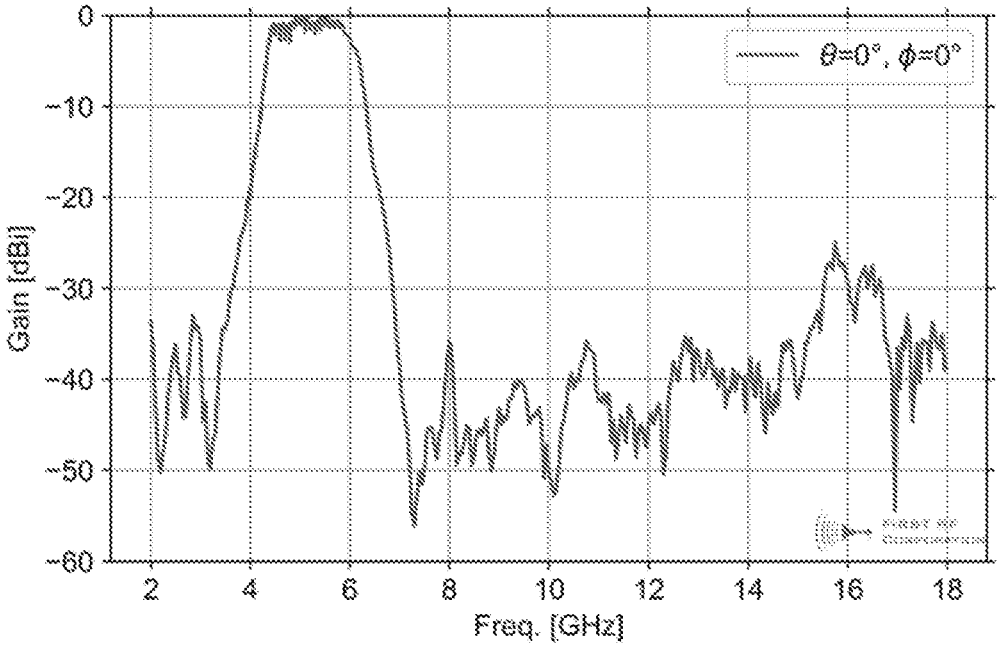
FIG. 17 is a plot of gain versus frequency of an antenna array when fed by a second prototype corporate power splitter.

FIG. 17 is a plot of gain versus frequency of the antenna array 108 when fed by the second prototype corporate power splitter. Similar to FIG. 16, the data in FIG. 17 was measured with a probe antenna that was placed in front of the antenna array 108 to measure the electromagnetic field emitted by the antenna array 108 in its forward direction. The second prototype included an additional low-pass filter to block transmission of signals at the odd harmonics of the center frequency $f_c$. The gain is normalized to its peak value near $f_c$.

Method Embodiments

Figure 18:
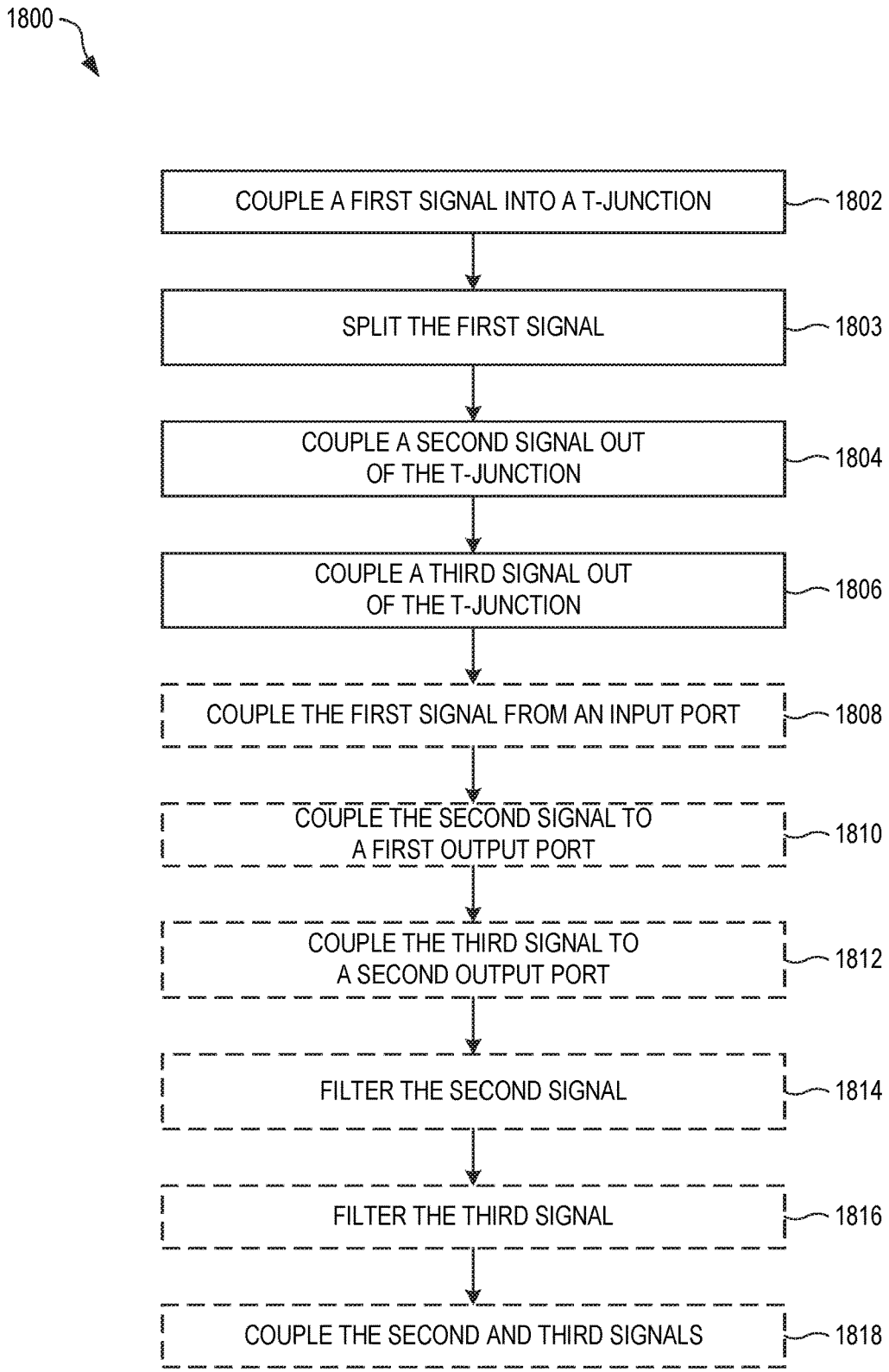
FIG. 18 is a flow chart of a power-dividing method, in embodiments.

FIG. 18 is a flow chart of a power-dividing method 1800. The method 1800 may be implemented with the filtering power divider 500 of FIG. 5, the filtering power divider 700 of FIG. 7, or the filtering power divider 1400 of FIG. 14. In a block 1802 of the method 1800, a first signal is coupled into a T-junction through a first partial transmission line having a first electrical length. In one example of the block 1802, the input signal 550 is coupled into the T-junction 506 through the first partial transmission line 514. In a block 1803 of the method 1800, the first signal is split, by the T-junction, into second and third signals. In one example of the block 1803, the T-junction 506 splits the input signal 550 into first and second output signals 552(1), 552(2).

In a block 1804 of the method 1800, the second signal is coupled out of the T-junction through a second partial transmission line having a second electrical length. In a block 1806 of the method 1800, the third signal is coupled out of the T-junction through a third partial transmission line having the second electrical length. A sum of the first and second electrical lengths may equal ninety degrees (e.g., at a center frequency $f_c$). In one example of the block 1804, the first output signal 552(1) is coupled out of the T-junction 506 through the second partial transmission line 516. In one example of the block 1806, the second output signal 552(2) is coupled out of the T-junction 506 through the third partial transmission line 517.

In some embodiments, the T-junction splits the first signal such that the second and third signals have equal powers (i.e., the T-junction splits the first signal equally into the second and third signals). In other embodiments, the T-junction splits the first signal such that the second and third signals have different powers (i.e., the T-junction splits the first signal equally into the second and third signals).

In some embodiments, the method 1800 includes blocks 1808, 1810, 1812, 1814, and 1816 that occur simultaneously with any one or more of the blocks 1802, 1803, 1804, and 1806. In the block 1808, the first signal is coupled, with a first set of one or more transmission lines, from an input port to an input end of the first partial transmission line. In one example of the block 1808, the input signal 550 is coupled with the three transmission lines 510(1), 512, and 510(2) to the second end 507(2) of the first partial transmission line 514. In the block 1810, the second signal is coupled, with a second set of one or more transmission lines, from an output end of the second partial transmission line to a first output port. In one example of the block 1810, the output signal 552(1) is coupled, with the five transmission lines 518(1), 519(1), 518(2), 519(2), and 518(3), from the second end 508(2) of the second partial transmission line 516 to the first output port 522(1). In the block 1812, the third signal is coupled, with a third set of one or more transmission lines, from an output end of the third partial transmission line to a second output port. In one example of the block 1812, the output signal 552(2) is coupled, with the five transmission lines 518(4), 519(3), 518(5), 519(4), and 518(6), from the second end 509(2) of the third partial transmission line 517 to the second output port 522(2).

In the block 1814, the second signal is filtered with the first set of transmission lines, the first partial transmission line, the second partial transmission line, and the second set of transmission lines. In one example of the block 1814, the first output signal 552(1) is filtered with the transmission lines 510(1), 512, and 510(2); the first partial transmission line 514; the second partial transmission line 516; and the transmission lines 518(1), 519(1), 518(2), 519(2), and 518(3). In the block 1816, the third signal is filtered with the first set of transmission lines, the first partial transmission line, the third partial transmission line, and the third set of transmission lines. In one example of the block 1814, the first output signal 552(1) is filtered with the transmission lines 510(1), 512, and 510(2); the first partial transmission line 514; the third partial transmission line 517; and the transmission lines 518(4), 519(3), 518(5), 519(5), and 518(6). In the block 1814, the second signal may be bandpass filtered. Similarly, in the block 1816, the third signal may be bandpass filtered. However, a different type of filtering (e.g., bandstop, high-pass, low-pass, etc.) may be implemented with one or both of the blocks 1814 and 1816 without departing from the scope hereof.

In some embodiments, the method 1800 includes a block 1818 in which the second signal is coupled from the second partial transmission line to a first subsequent power divider, and in which the third signal is coupled from the third partial transmission line to a second subsequent power divider. In one example of the block 1818, the first intermediate signal 126(1) outputted by the first output port 122 of the first power divider 102(1) of FIG. 1 is coupled to the input port 120 of the second power divider 102(2), and the second intermediate signal 126(2) outputted by the second output port 124 of the first power divider 102(1) is coupled to the input port 120 of the third power divider 102(3). The second signal may be coupled, from the second partial transmission line, either directly to the first subsequent power divider (i.e., without any intervening components or transmission lines), or indirectly to the first subsequent power divider (i.e., with intervening components or transmission lines, such as one or both of the transformer 1402(1) and output stage 1404(1) of FIG. 14). Similarly, the third signal may be coupled, from the third partial transmission line, either directly or indirectly to the second subsequent power divider.

In an alternative version of the block 1818, the second signal is coupled from the second partial transmission line to a first antenna element of an antenna array, and the third signal is coupled from the third partial transmission line to a second antenna element of the antenna array. In one example of this alternative version of the block 1818, the first output signal 106(1) from the first output port 122 of the second power divider 102(2) of FIG. 1 is coupled to the first antenna element 104(1) of the antenna array 108, and the second output signal 106(2) from the second output port 124 of the second power divider 102(2) is coupled to the second antenna element 104(2) of the antenna array 108. The second signal may be coupled either directly from the second partial transmission line to the first antenna element (i.e., without any intervening components or transmission lines), or indirectly (i.e., with intervening components or transmission lines, such as one or both of the transformer 1402(1) and output stage 1404(1) of FIG. 14). Similarly, the third signal may be coupled either directly or indirectly to the second antenna element.

In some embodiments of the method 1800, a characteristic impedance of the second partial transmission line is transformed, with a first impedance transformer that couples the output end of the second partial transmission line with an input of the second set of transmission lines, such that the first output port has a first output impedance. In addition, a characteristic impedance of the third partial transmission line is transformed, with a second impedance transformer that couples the output end of the third partial transmission line with an input of the third set of transmission lines, such that the second output port has a second output impedance. In one example of these embodiments, the first impedance transformer 1403(1) of FIG. 14 couples the second end 508(2) of the second partial transmission line 516 to an input of the first output stage 1404(1). The first transformer 1403(1) cooperates with the first output stage 1404(1), when included, to transform the characteristic impedance of the second partial transmission line 516 to a first output impedance of the first output port 522(1). Similarly, the second impedance transformer 1403(2) of FIG. 14 couples the second end 509(2) of the third partial transmission line 517 to an input of the second output stage 1404(2). The second impedance transformer 1403(2) cooperates with the second output stage 1404(2), when included, to transform the characteristic impedance of the third partial transmission line 517 to a second output impedance of the second output port 522(2). The first and second output impedances may be equal (e.g., both are 50Ω) or unequal (e.g., one is 40Ω and the other is 75Ω).

In one embodiment of the method 1800, a resistor connected between an output end of each of the second and third partial transmission lines isolates: (i) the output end of the second partial transmission line from a fourth signal coupling into the third partial transmission line through the output end of the third partial transmission line, and (ii) the output end of the third partial transmission line from a fifth signal coupling into the second partial transmission line through the output end of the second partial transmission line. In another embodiment of the method 1800, a resistor connected between the first and second output ports isolates: (i) the first output port from a fourth signal coupling into second output port, and (ii) the second output port from a fifth signal coupling into the first output port. In one example of this embodiment, the resistor 562 helps prevent the first reverse signal 554(1) from coupling out of the second output port 522(2) as part of the second output signal 552(2), and helps prevent the second reverse signal 554(2) from coupling out of the first output port 522(1) as part of the first output signal 552(1).

Figure 19:
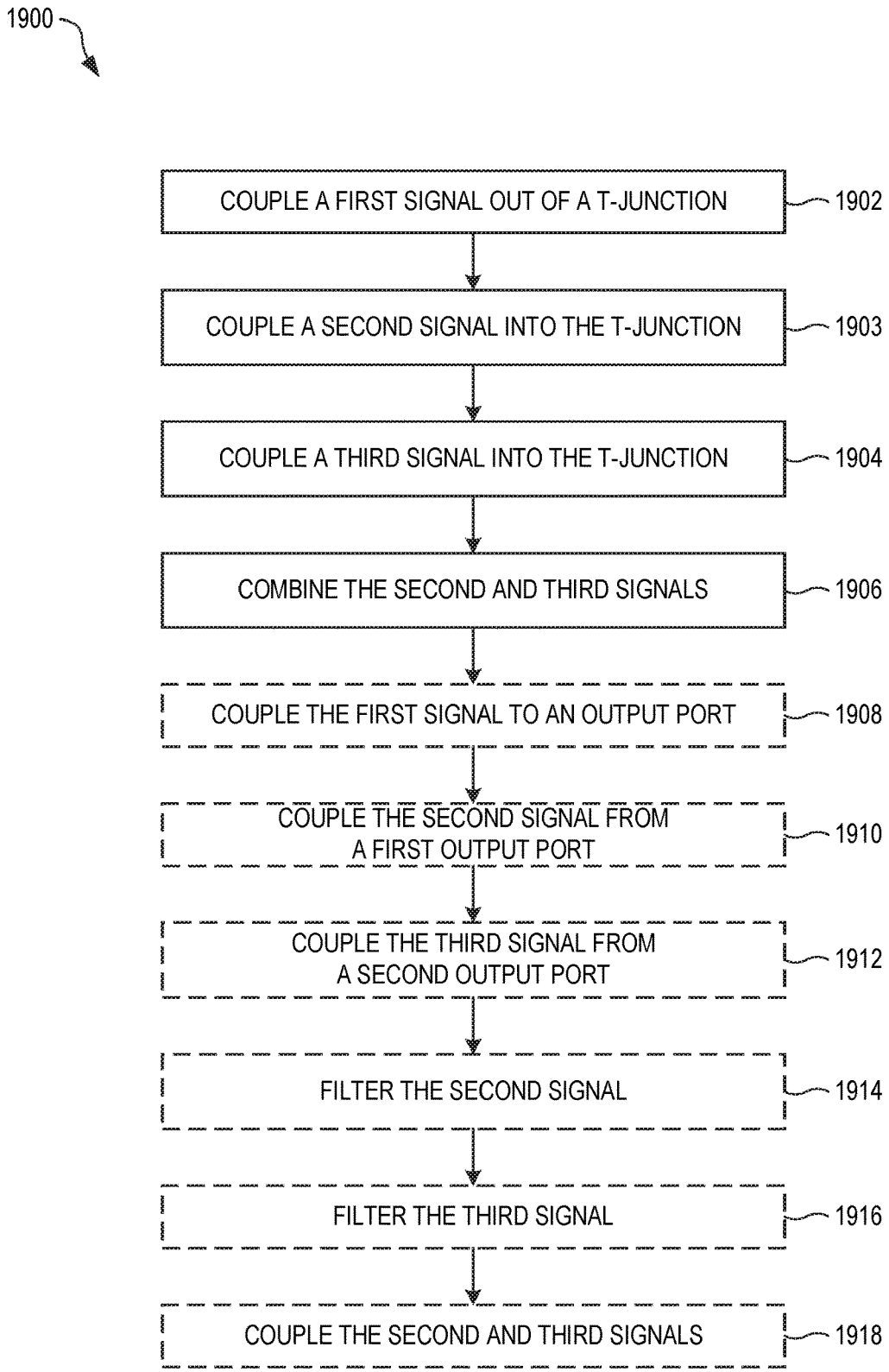
FIG. 19 is a flow chart of a power-combining method, in embodiments.

FIG. 19 is a flow chart of a power-combining method 1900. The method 1900 may be implemented with the filtering power divider 500 of FIG. 5, the filtering power divider 700 of FIG. 7, or the filtering power divider 1400 of FIG. 14. In a block 1902 of the method 1900, a first signal is coupled out of a T-junction through a first partial transmission line having a first electrical length. In one example of the block 1902, the third reverse signal 560 is coupled out of the T-junction 506 through the first partial transmission line 514. In a block 1903 of the method 1900, a second signal is coupled into the T-junction through a second partial transmission line having a second electrical length. In one example of the block 1903, the first reverse signal 554(1) is coupled into the T-junction 506 through the second partial transmission line 516. In a block 1904 of the method 1900, a third signal is coupled into the T-junction through a third partial transmission line having the second electrical length. In one example of the block 1904, the second reverse signal 554(2) is coupled into the T-junction 506 through the third partial transmission line 517.

In a block 1906 of the method 1900, the second and third signals are combined, with the T-junction into the first signal. In one example of the block 1906, the T-junction 506 combines the first and second reverse signals 554(1), 554(2) into the third reverse signal 560. A sum of the first and second electrical lengths may be ninety degrees (at a center frequency $f_c$).

In some embodiments, the method 1900 includes blocks 1908, 1910, 1912, 1914, and 1916 that occur simultaneously with any one or more of the blocks 1902, 1903, 1904, and 1906. In the block 1908, the first signal is coupled, with a first set of one or more transmission lines, from an output end of the first partial transmission line to an output port. In one example of the block 1808, the third reverse signal 560 is coupled, with the three transmission lines 510(1), 512, and 510(2), from the second end 507(2) of the first partial transmission line 514 to the port 520. In the block 1910, the second signal is coupled, with a second set of one or more transmission lines, from a first input power to an input end of the second partial transmission line. In one example of the block 1910, the first reverse signal 554(1) is coupled, with the five transmission lines 518(1), 519(1), 518(2), 519(2), and 518(3), from the port 522(1) to the second end 508(2) of the second partial transmission line 516. In the block 1912, the third signal is coupled, with a third set of one or more transmission lines, from a second input port to an input end of the third partial transmission line. In one example of the block 1912, the second reverse signal 554(2) is coupled, with the five transmission lines 518(4), 519(3), 518(5), 519(4), and 518(6), from the port 522(2) to the second end 509(2) of the third partial transmission line 517.

In the block 1914, the second signal is filtered with the second set of transmission lines, the second partial transmission line, the first partial transmission line, and the first set of transmission lines. In one example of the block 1914, the first reverse signal 554(1) is filtered with the transmission lines 518(1), 519(1), 518(2), 519(2), and 518(3); the second partial transmission line 516; the first partial transmission line 514; and the transmission lines 510(1), 512, and 510(2). In the block 1916, the third signal is filtered with the third set of transmission lines, the third partial transmission line, the first partial transmission line, and the first set of transmission lines. In one example of the block 1916, the second reverse signal 554(1) is filtered with the transmission lines 518(4), 519(3), 518(5), 519(5), and 518(6); the third partial transmission line 517; the first partial transmission line 514; and the transmission lines 510(1), 512, and 510(2). In the block 1914, the second signal may be bandpass filtered. Similarly, in the block 1916, the third signal may be bandpass filtered. However, a different type of filtering (e.g., bandstop, high-pass, low-pass, etc.) may be implemented with one or both of the blocks 1914 and 1916 without departing from the scope hereof.

In some embodiments, the method 1900 includes a block 1918 in which the second signal is coupled into the second partial transmission line from a first previous power combiner, and in which the third signal is coupled into the third partial transmission line from a second previous power combiner. In one example of the block 1918, the antenna array 108 of FIG. 1 receives the electromagnetic beam 110, wherein the second power divider 102(2) outputs the first intermediate signal 126(1) and the third power divider 102(3) outputs the second intermediate signal 126(2). The first power divider 102(1) combines the first and second intermediate signals 126(1), 126(2) to generate the one output signal 118. The second signal may be coupled into the second partial transmission line either directly from the first previous power combiner (i.e., without any intervening components or transmission lines), or indirectly from the first previous power combiner (i.e., with intervening components or transmission lines, such as one or both of the transformer 1402(1) and the output stage 1404(1) of FIG. 14). Similarly, the third signal may be coupled into the third partial transmission line either directly or indirectly from the second previous power combiner.

In an alternative version of the block 1918, the second signal is coupled into the second partial transmission line from a first antenna element of an antenna array, and the third signal is coupled into the third partial transmission line from a second antenna element of the antenna array. In one example of this alternative version of the block 1918, the antenna array 108 of FIG. 1 receives the electromagnetic beam 110, wherein signal 106(1) is coupled into the port 122 of the power divider 102(2), and the signal 106(2) is coupled into the port 124 of the power divider 102(2). The second signal may be coupled into the second partial transmission line either directly from the first antenna element (i.e., without any intervening components or transmission lines), or indirectly from the first antenna element (i.e., with intervening components or transmission lines, such as one or both of the transformer 1402(1) and output stage 1404(1) of FIG. 14). Similarly, the third signal may be coupled into the third partial transmission line either directly or indirectly from the second antenna element.

In some embodiments of the method 1900, a characteristic impedance of the second partial transmission is transformed, with a first impedance transformer that couples an output of the second set of one or more transmission lines to the input end of the second partial transmission line, such that the first input port has a first input impedance. In addition, a characteristic impedance of the third partial transmission line is transformed, with a second impedance transformer that couples an output of the third set of one or more transmission lines to the input end of the third partial transmission line, such that the second input port has a second input impedance. In one example of these embodiments, the first impedance transformer 1403(1) of FIG. 14 cooperates with the first output stage 1404(1), when included, to transform the impedance of the port 522(1) to the characteristic impedance of the second partial transmission line 516. Similarly, the second impedance transformer 1403(2) of FIG. 14 cooperates with the second output stage 1404(2), when included, to transform the impedance of the port 522(2) to the characteristic impedance of the third partial transmission line 517. The first and second input impedances may be equal (e.g., both are 50Ω) or unequal (e.g., one is 40Ω and the other is 75Ω).

In one embodiment of the method 1900, a resistor connected between an input end of each of the second and third partial transmission lines isolates (i) the input end of the second partial transmission line from the third signal, and (ii) the input end of the third partial transmission line from the second signal. In another embodiment of the method 1900, a resistor connected between the first and second input ports isolates (i) the first input port from the third signal, and (ii) the second input port from the second signal. In one example of this embodiment, the resistor 562 helps prevent the first reverse signal 554(1) from coupling out of the second output port 522(2) as part of the second output signal 552(2), and helps prevent the second reverse signal 554(2) from coupling out of the first output port 522(1) as part of the first output signal 552(1).

ADDITIONAL CONFIGURATIONS

While the above description features a five-stage Chebyshev bandpass filter, the present embodiments may be alternatively configured to implement a different type of filter without departing from the scope hereof. For example, shunted quarter-wave transmission lines may be ungrounded to form a five-stage Chebyshev band-reject filter. The embodiments may be alternatively configured to implement a low-pass or high-pass filter, or to implement a different type of filter response (e.g., Butterworth, elliptic, Bessel, etc.). In addition, the embodiments may be alternatively configured with a different number of filtering stages (e.g., three, seven, nine, etc.).

As known by those trained in the art, each shunted quarter-wave transmission line described herein may be replaced with an open (i.e., ungrounded) half-wave transmission line, or an appropriately configured transmission line whose electrical length is a different multiple of a quarter wavelength. Each series-connected quarter-wave transmission line described herein may be similarly replaced with an appropriately configured transmission line whose electrical length is a multiple of a quarter wavelength.

While the embodiments described above show resonators (e.g., resonators 312 of FIG. 3) implemented as quarter-wave transmission lines, the present embodiments may be alternatively configured to implement each resonator as a different type of component without departing from the scope hereof. For example, each quarter-wave transmission line may be alternatively implemented as a transmission line of a different length (e.g., a half-wave transmission line). Each resonator may be alternatively implemented as a lumped element, such as a helical resonator or a quartz resonator. The resonators may also be alternatively implemented as a different type of distributed element, such as parallel-coupled lines (e.g., interdigital coupled lines or hairpin coupled lines). While the embodiments described above show each quarter-wave transmission line as a rectangular stub, each quarter-wave transmission line may be alternatively configured with a different geometry (e.g., bowtie, butterfly, radial, clover-leaf, etc.).

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A filtering power divider comprising:

a first partial transmission line having a first electrical length;

a second partial transmission line having a second electrical length; and a third partial transmission line having the second electrical length;

wherein a first end of each of the first, second, and third partial transmission lines connect to form a T-junction, and a sum of the first and second electrical lengths is ninety degrees.

2. The filtering power divider of claim 1, wherein a characteristic impedance of each of the second and third partial transmission lines equals twice a characteristic impedance of the first partial transmission line such that the T-junction splits a signal, propagating along the first partial transmission line and toward the T-junction, equally between the second and third partial transmission lines.

3. The filtering power divider of claim 1, wherein:

characteristic impedances of the second and third partial transmission lines are unequal such that the T-junction splits a signal, propagating along the first partial transmission line and toward the T-junction, unequally between the second and third partial transmission lines; and a parallel impedance of the second and third partial transmission lines equals a characteristic impedance of the first partial transmission line.

4. The filtering power divider of claim 1, further comprising a resistor between a second end of each of the second and third partial transmission lines.

5. The filtering power divider of claim 1, further comprising:

a first set of one or more transmission lines connecting a second end of the first partial transmission line to an input port of the filtering power divider;

a second set of one or more transmission lines connecting a second end of the second partial transmission line to a first output port of the filtering power divider; and a third set of one or more transmission lines connecting a second end of the third partial transmission line to a second output port of the filtering power divider;

wherein the first and second sets of transmission lines cooperate with the first and second partial transmission lines to implement a filter between the input port and the first output port, and the first and third sets of transmission lines cooperate with the first and third partial transmission lines to implement the filter between the input port and the second output port.

6. The filtering power divider of claim 5, wherein each of the transmission lines of the first, second, and third sets is a quarter-wave transmission line.

7. The filtering power divider of claim 5, the filter being a bandpass filter with at least two filter stages, wherein at least one of the filter stages is implemented with the first set of transmission lines, and at least one of the filter stages is implemented with each of the second and third sets of transmission lines.

8. The filtering power divider of claim 5, the filter being a bandpass filter, wherein each of the first, second, and third sets of transmission lines includes at least one grounded quarter-wave stub.

9. The filtering power divider of claim 5, each of the first and second output ports being coupled to an input port of a subsequent power divider.

10. The filtering power divider of claim 5, each of the first and second output ports being coupled to an antenna element of an antenna array.

11. The filtering power divider of claim 5, further comprising:

a first impedance transformer coupling the second end of the second partial transmission line to the second set of transmission lines, the first impedance transformer being configured to (i) cooperate with the second set of transmission lines to transform a characteristic impedance of the second partial transmission line to a first output impedance of the first output port, and (ii) cooperate with the first and second partial transmission lines, and the first and second sets of transmission lines, to implement the filter between the input port and the first output port; and a second impedance transformer coupling the second end of the third partial transmission line to the third set of transmission lines, the second impedance transformer being configured to (i) cooperate with the third set of transmission lines to transform a characteristic impedance of the third partial transmission line to a second output impedance of the second output port, and (ii) cooperate with the first and third partial transmission lines, and the first and third sets of transmission lines, to implement the filter between the input port and the second output port.

12. The filtering power divider of claim 11, each of the first and second output impedances being less than twice an input impedance of the input port.

13. The filtering power divider of claim 11, each of the first and second output impedances being equal to an input impedance of the input port.

14. The filtering power divider of claim 11, the first impedance transformer comprising:

a first grounded quarter-wave stub connected to the second end of the second partial transmission line;

a first series-connected quarter-wave transmission line having a first end connected to the second end of the second partial transmission line; and a second grounded quarter-wave stub connected to a second end of the first series-connected quarter-wave transmission line; and the second impedance transformer comprising:

a third grounded quarter-wave stub connected to the second end of the third partial transmission line;

a second series-connected quarter-wave transmission line having a first end connected to the second end of the third partial transmission line; and a fourth grounded quarter-wave stub connected to a second end of the second series-connected quarter-wave transmission line.

15. A power-dividing method, comprising:

coupling a first signal into a T-junction through a first partial transmission line having a first electrical length;

splitting, with the T-junction, the first signal into second and third signals;

coupling the second signal out of the T-junction through a second partial transmission line having a second electrical length; and coupling the third signal out of the T-junction through a third partial transmission line having the second electrical length;

wherein a sum of the first and second electrical lengths is ninety degrees.

16. The power-dividing method of claim 15, wherein said splitting includes splitting the first signal such that the second and third signals have equal powers.

17. The power-dividing method of claim 15, further comprising:

coupling, with a first set of one or more transmission lines, the first signal from an input port to an input end of the first partial transmission line;

coupling, with a second set of one or more transmission lines, the second signal from an output end of the second partial transmission line to a first output port; and coupling, with a third set of one or more transmission lines, the third signal from an output end of the third partial transmission line to a second output port;

filtering the second signal with the first set of one or more transmission lines, the first partial transmission line, the second partial transmission line, and the second set of one or more transmission lines; and filtering the third signal with the first set of one or more transmission lines, the first partial transmission line, the third partial transmission line, and the third set of one or more transmission lines;

wherein an output end of the first partial transmission line, an input end of the second partial transmission line, and an input end of the third partial transmission line connect to form the T-junction.

18. The power-dividing method of claim 17, further comprising:

transforming, with a first impedance transformer that couples the output end of the second partial transmission line with an input of the second set of one or more transmission lines, a characteristic impedance of the second partial transmission line such that the first output port has a first output impedance; and transforming, with a second impedance transformer that couples the output end of the third partial transmission line with an input of the third set of one or more transmission lines, a characteristic impedance of the third partial transmission line such that the second output port has a second output impedance.

19. The power-dividing method of claim 15, further comprising:

coupling the second signal from the second partial transmission line to a first subsequent power divider; and coupling the third signal from the third partial transmission line to a second subsequent power divider.

20. The power-dividing method of claim 15, further comprising:

coupling the second signal from the second partial transmission line to a first antenna element of an antenna array; and coupling the third signal from the third partial transmission line to a second antenna element of the antenna array.

21. A power-combining method comprising:

coupling a first signal out of a T-junction through a first partial transmission line having a first electrical length;

coupling a second signal into the T-junction through a second partial transmission line having a second electrical length;

coupling a third signal into the T-junction through a third partial transmission line having the second electrical length; and combining, with the T-junction, the second and third signals into the first signal;

wherein a sum of the first and second electrical lengths is ninety degrees.

22. The power-combining method of claim 21, further comprising:

coupling, with a first set of one or more transmission lines, the first signal from an output end of the first partial transmission line to an output port;

coupling, with a second set of one or more transmission lines, the second signal from a first input port to an input end of the second partial transmission line; and coupling, with a third set of one or more transmission lines, the third signal from a second input port to an input end of the third partial transmission line;

filtering the second signal with the second set of one or more transmission lines, the second partial transmission line, the first partial transmission line, and the first set of one or more transmission lines; and filtering the third signal with the third set of one or more transmission lines, the third partial transmission line, the first partial transmission line, and the first set of one or more transmission lines;

wherein an input end of the first partial transmission line, an output end of the second partial transmission line, and an output end of the third partial transmission line connect to form the T-junction.

23. The power-combining method of claim 22, further comprising:

transforming, with a first impedance transformer that couples an output of the second set of one or more transmission lines to the input end of the second partial transmission line, a characteristic impedance of the second partial transmission line such that the first input port has a first input impedance; and transforming, with a second impedance transformer that couples an output of the third set of one or more transmission lines to the input end of the third partial transmission line, a characteristic impedance of the third partial transmission line such that the second input port has a second input impedance.

24. The power-combining method of claim 21, further comprising:

coupling the second signal into the second partial transmission line from a first previous power combiner; and coupling the third signal into the third partial transmission line from a second previous power combiner.

25. The power-combining method of claim 21, further comprising:

coupling the second signal into the second partial transmission line from a first antenna element of an antenna array; and coupling the third signal into the third partial transmission line from a second antenna element of the antenna array.

* * * * *